US010228150B2

(12) United States Patent
Lee et al.

(10) Patent No.: US 10,228,150 B2
(45) Date of Patent: Mar. 12, 2019

(54) HUMIDIFYING APPARATUS

(71) Applicant: Samsung Electronics Co., Ltd, Gyeonggi-do (KR)

(72) Inventors: Sang Hoon Lee, Gyeonggi-do (KR); Jeong Myeong Kim, Seoul (KR); Yong Jong Park, Gyeonggi-do (KR); Han Wook Cho, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 147 days.

(21) Appl. No.: 15/167,812

(22) Filed: May 27, 2016

(65) Prior Publication Data

US 2016/0348929 A1 Dec. 1, 2016

(30) Foreign Application Priority Data

May 27, 2015 (KR) ..... 10-2015-0073554
Dec. 24, 2015 (KR) ..... 10-2015-0186031

(51) Int. Cl.
*F24F 6/04* (2006.01)
*F24F 6/00* (2006.01)

(52) U.S. Cl.
CPC ..... *F24F 6/04* (2013.01); *F24F 2006/006* (2013.01); *F24F 2006/008* (2013.01); *F24F 2006/046* (2013.01)

(58) Field of Classification Search
CPC .. F24F 6/04; F24F 2006/006; F24F 2006/046; F24F 2006/008
See application file for complete search history.

(56) References Cited

U.S. PATENT DOCUMENTS 654,725 A * 7/1900 Gardner ..... F24F 6/04 261/103
684,217 A * 10/1901 Gardner et al. ..... F24F 6/04 261/103

(Continued)

FOREIGN PATENT DOCUMENTS

CN 1712818 * 12/2005
JP 2010/019444 * 1/2010

(Continued)

OTHER PUBLICATIONS

EPO machine translation of Yoshifumi et al. JP 2010/019444 (Year: 2010).*

(Continued)

*Primary Examiner* — Stephen Hobson

(57) ABSTRACT

Disclosed herein are a humidifying apparatus which may be prevented from being contaminated. A humidifying apparatus comprises a water tank configured to store water, a filter assembly configured to filter the water stored in the water tank and a humidifying assembly configured to perform humidification by absorbing and vaporizing the water filtered by the filter assembly, a drain flow passage provided at a lower surface of the humidifying assembly, wherein residual water remaining after being absorbed in the humidifying assembly is recovered in the water tank via the drain flow passage, and a guide rib configured to guide the water recovered in the water tank is provided in the water tank.

19 Claims, 33 Drawing Sheets

(56) References Cited

U.S. PATENT DOCUMENTS 1,283,950 A * 11/1918 Stiefel ..... F24F 6/04 261/103
1,903,250 A * 3/1933 Tenney ..... F24F 6/04 165/116
2,099,009 A * 11/1937 Finley ..... F24D 19/0082 160/44
2,161,834 A * 6/1939 Seeley ..... F24D 19/0082 237/78 R
2,326,089 A * 8/1943 Wittman ..... F24D 19/0082 126/113
3,119,887 A * 1/1964 Baehr ..... F24D 5/00 126/113
3,337,196 A * 8/1967 McCoy ..... F24F 6/04 261/105
3,497,453 A * 2/1970 Yurdin ..... F24F 6/04 210/167.3
4,389,352 A * 6/1983 Bohanon, Sr. ..... F24F 6/04 261/106
5,226,935 A * 7/1993 Wolff ..... B05B 17/085 239/193
5,282,972 A * 2/1994 Hanna ..... B01D 61/025 210/137
5,520,816 A * 5/1996 Kuepper ..... B01D 61/025 210/649
5,624,610 A * 4/1997 Yokoya ..... F24F 3/1417 134/3
5,948,324 A * 9/1999 Cook ..... F24F 6/00 261/106
7,052,600 B2 * 5/2006 McKay ..... C02F 1/4606 204/248
9,816,715 B2 * 11/2017 Morikawa ..... F24F 3/14
2005/0269254 A1 * 12/2005 Roitman ..... B01D 5/0072 210/252
2007/0181000 A1 * 8/2007 Wilson ..... A61L 9/014 96/134
2008/0072757 A1 * 3/2008 Dobashi ..... A61L 9/14 96/19
2011/0192179 A1 * 8/2011 Freije, III ..... F24F 5/0035 62/121
2011/0315632 A1 * 12/2011 Freije, III ..... B01D 61/12 210/636
2013/0025462 A1 * 1/2013 Yun ..... B01D 45/14 96/256
2013/0106004 A1 * 5/2013 Stumphauzer ..... F24F 6/04 261/128
2013/0186611 A1 * 7/2013 Schneider ..... F24F 11/0008 165/226
2013/0213076 A1 * 8/2013 Gerlach ..... F24F 13/15 62/314
2015/0219346 A1 * 8/2015 Morikawa ..... F24F 3/14 261/136
2015/0354852 A1 * 12/2015 Liaw ..... F24H 3/022 392/347
2016/0251521 A1 * 9/2016 Izutani ..... C09D 1/00 261/101
2018/0094825 A1 * 4/2018 Peczalski ..... F24F 13/22

FOREIGN PATENT DOCUMENTS

JP 2010-019447 1/2010
JP 5241351 B2 * 7/2013
JP 2016114323 A * 6/2016
KR 10-2004-0018847 3/2004
KR 200369288 12/2004
KR 10-2012-0122659 11/2012
KR 10-2014-0002358 1/2014
WO 0116028 A1 3/2001
WO WO-2004055444 A1 * 7/2004 ..... F24F 6/14
WO 2014/146387 A1 9/2014

OTHER PUBLICATIONS

EPO machine translation of Bingyong CN 1712818 (Year: 2005).*
International Search Report dated Aug. 24, 2016 in connection with International Application No. PCT/KR2016/005571, 3 pages.
Supplementary European Search Report dated Mar. 16, 2018 in connection with European Patent Application No. 16 80 0314.

* cited by examiner

HUMIDIFYING APPARATUS

CROSS-REFERENCE TO RELATED APPLICATION(S) AND CLAIM OF PRIORITY

The present application is related to and claims the benefit of Korean Patent Application Nos. 10-2015-0073554 and 10-2015-0186031, filed on May 27, 2015 and Dec. 24, 2015, respectively in the Korean Intellectual Property Office, the disclosure of which is incorporated herein by reference.

TECHNICAL FIELD

Embodiments of the present disclosure relate to a humidifying apparatus having improved performance.

BACKGROUND

A humidifying apparatus refers to an apparatus that adjusts the humidity of a room by vaporizing water. The humidifying apparatus may be classified into an ultrasonic humidifier for vaporizing water using ultrasonic waves, a heating type humidifier for vaporizing water by heating water, an evaporative humidifier for performing a humidifying operation through natural vaporization, and a humidifier using two or more thereof.

The evaporative humidifier may include a water storage tank that stores water required for humidification, and a humidifying unit that is provided to receive the water stored in the water storage tank and increase a contact area with air. The evaporative humidifier may further include a blower fan for blowing air containing vapor that is vaporized from the humidifying unit.

Minerals such as magnesium or calcium, organic matter, and the like may be contained in ground water or tap water used in the humidifier. Depending on the use of the humidifier, minerals, organic matter, and the like may be precipitated into scale, residue, etc., and thereby fixed to the inside of the humidifier. If this is allowed to stand, the humidifying unit may be contaminated to cause discoloration or odor. In addition, in a case in which the humidifying unit is provided in the form of a rotatable humidifying disk, noise may occur by scale generated between a rotating shaft and the humidifying disk when the humidifying disk is rotated.

Thus, in order to prevent the occurrence of discoloration, odor, and noise, a user is required to periodically clean the humidifier. This may seem as an inconvenience for a user to use the humidifier.

SUMMARY

To address the above-discussed deficiencies, it is a primary object to provide a humidifying apparatus that removes minerals, organic matter, and the like contained in water from the water, and transmits the resultant water to a humidifying unit.

Additional aspects of the disclosure will be set forth in part in the description which follows and, in part, will be obvious from the description, or may be learned by practice of the disclosure.

In according with one aspect of the present disclosure, a humidifying apparatus comprises: a water tank configured to store water; a filter assembly configured to filter the water stored in the water tank; and a humidifying assembly configured to perform humidification by absorbing and vaporizing the water filtered by the filter assembly; a drain flow passage provided at a lower surface of the humidifying assembly, wherein residual water remaining after being absorbed in the humidifying assembly is recovered in the water tank via the drain flow passage, and a guide rib configured to guide the water recovered in the water tank is provided in the water tank.

In the lower surface of the humidifying assembly, a height of one side of the humidifying assembly at which the drain flow passage is provided from a bottom surface on which the humidifying assembly is located is formed to be lower than a height of an other side thereof from the bottom surface.

The drain flow passage is positioned to be biased toward one side of the humidifying assembly.

The humidifying apparatus further comprises a pump connected to the flow passage, wherein the residual water remaining after being absorbed in the humidifying assembly is pumped by the pump and recovered in the water tank.

A valve for opening and closing the drain flow passage is provided at the drain flow passage.

The water filtered by the filter assembly is supplied to the humidifying assembly, and circulating water remaining after being filtered flows into the water tank.

A circulation flow passage through which the circulating water flows-in is further provided at the water tank.

The circulation flow passage and the drain flow passage are provided as a single flow passage.

In the water tank, an inlet hole that communicates with a flow passage in which the circulation flow passage and the drain flow passage are provided as one is formed.

The water tank is positioned below the humidifying assembly, and the inlet hole is provided in an upper surface of the water tank.

The humidifying apparatus further comprises a pump configured to pump the water stored in the water tank and allow the pumped water to be delivered to the filter assembly.

A supply flow passage through which water supplied to the pump passes is provided at the water tank.

The supply flow passage extends toward a bottom surface of the water tank.

A height of an end of the supply flow passage from the bottom surface of the water tank is in a range of 1/10 to 1/4 of a height from the bottom surface of the water tank to the upper surface thereof.

An inlet hole through which circulating water of the filter assembly and the residual water of the humidifying assembly flow-in is provide in the water tank, and the supply flow passage configured to communicate with the inlet hole The supply flow passage includes a first supply flow passage that extends from the inside of the water tank to the inlet hole and a second supply flow passage that is bent and extended from the first supply flow passage.

The first supply flow passage extends parallel to the bottom surface of the water tank.

The second supply flow passage is bent from the first supply flow passage and extends toward the bottom surface of the water tank.

The supply flow passage includes a third supply flow passage that is bent from the second supply flow passage.

In according with one aspect of the present disclosure comprises: a humidifying pad configured to absorb and vaporize water; a distributor in which a plurality of spray holes are provided to supply water to the humidifying pad; a filter assembly connected to the distributor and configured to supply purified water to the distributor; a water tank in which water supplied to the filter assembly is stored and a guide rib configured to guide flowing-in water is provided; and a humidifying pad frame into which the humidifying pad is mounted and a drain flow passage is provided at a lower surface thereof, wherein one side of the lower surface of the humidifying pad frame at which the drain flow passage is provided to have an inclined surface in such a manner that a height of the one side of the lower surface of the humidifying pad frame from a bottom surface is lower than a height of the other side thereof from the bottom surface, and water drained via a distribution flow passage is recovered in the water tank.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
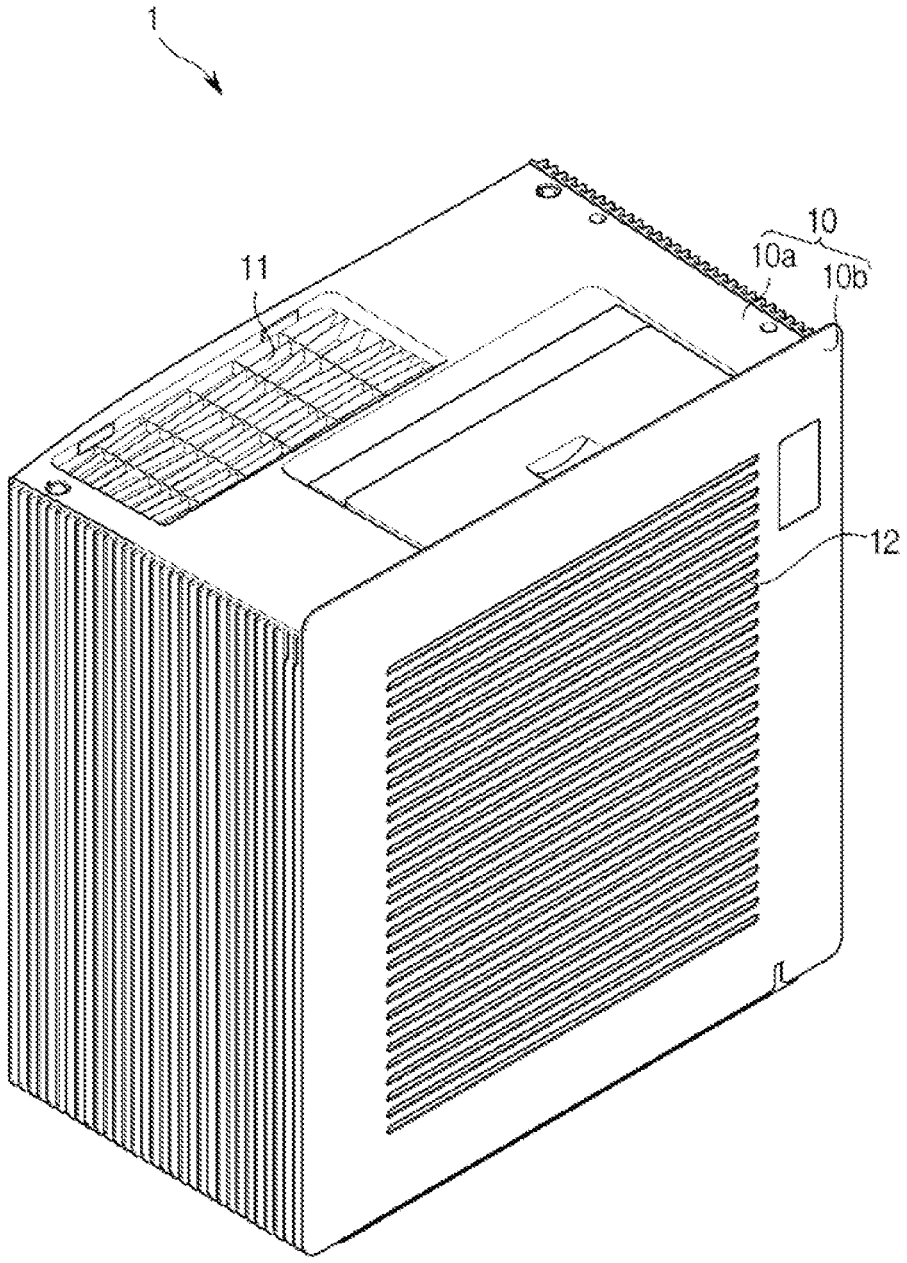
FIG. 1 illustrates a humidifying apparatus according to various embodiments of the present disclosure.

FIGS. 1 through 25, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. Reference will now be made in detail to the embodiments of the present disclosure, examples of which are illustrated in the accompanying drawings, wherein like reference numerals refer to like elements throughout.

Hereinafter, a humidifying apparatus according to an embodiment of the present disclosure will be described in detail with the accompanying drawings.

Figure 2:
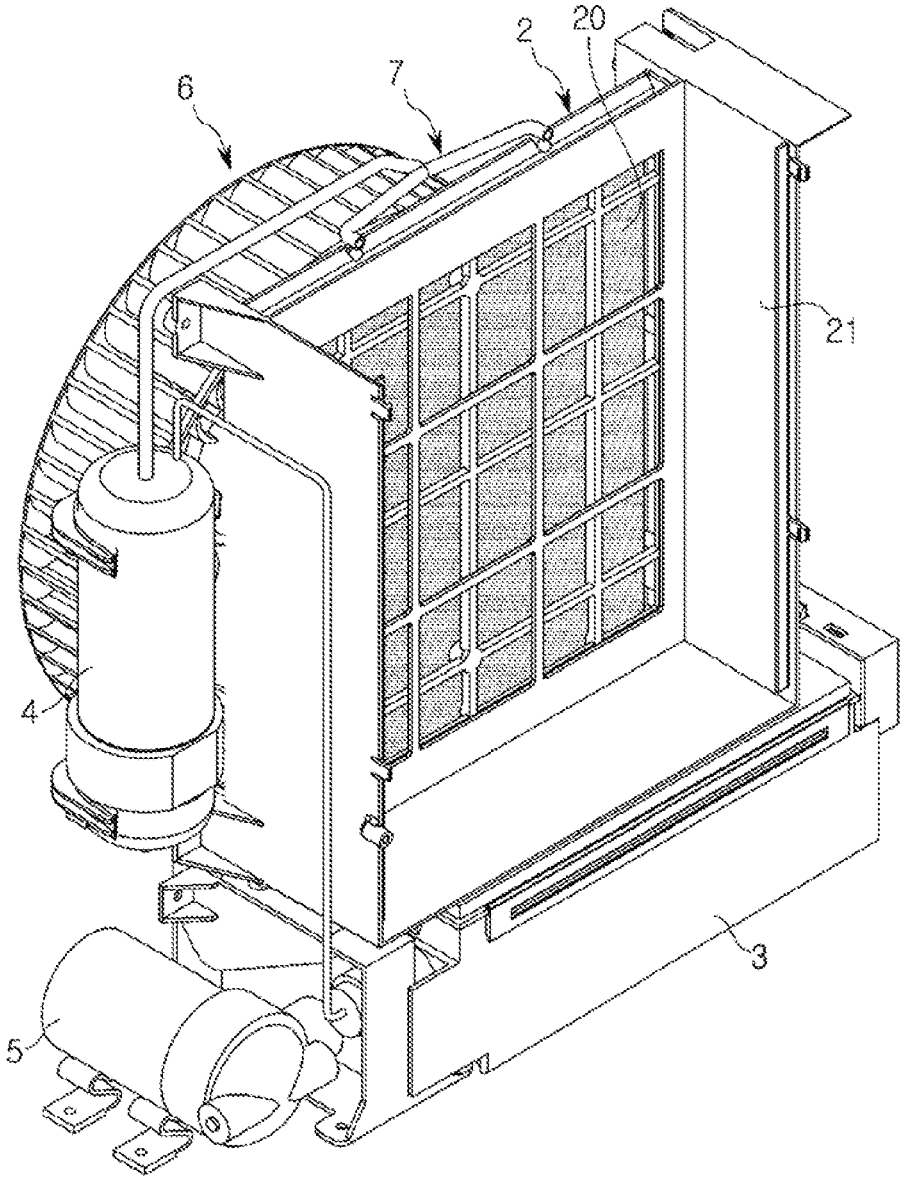
FIG. 2 illustrates the inside of a humidifying apparatus according to various embodiments of the present disclosure.
Figure 3:
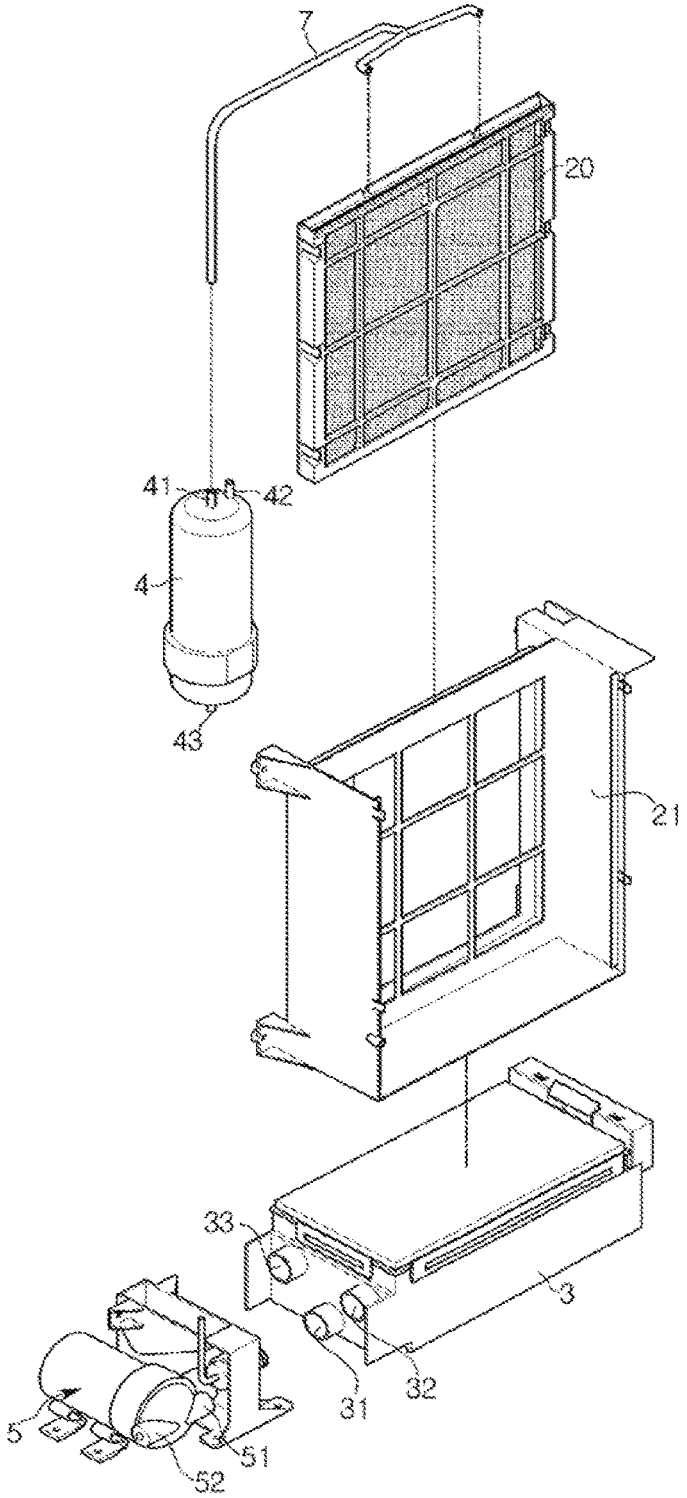
FIG. 3 illustrates a part of a humidifying apparatus according to various embodiments of the present disclosure.
Figure 4A:
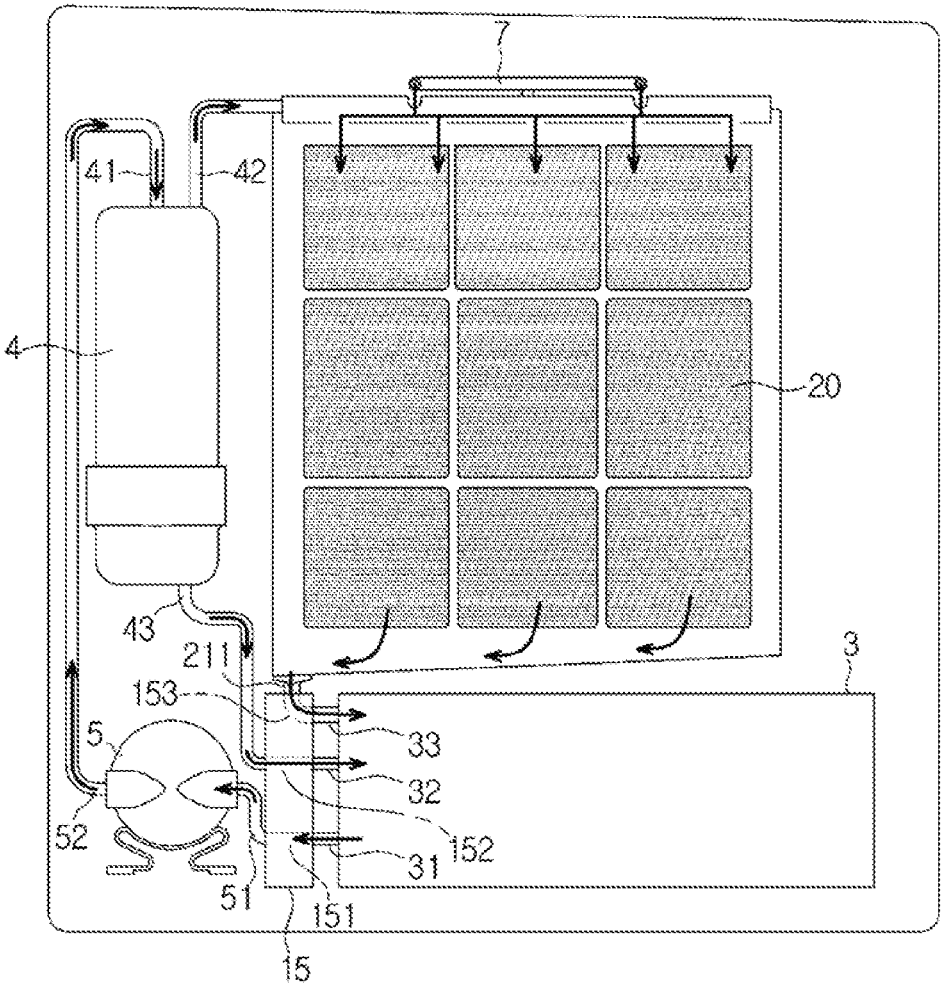
FIGS. 4A and 4B illustrate a humidifying apparatus according to various embodiments of the present disclosure.
Figure 4B:
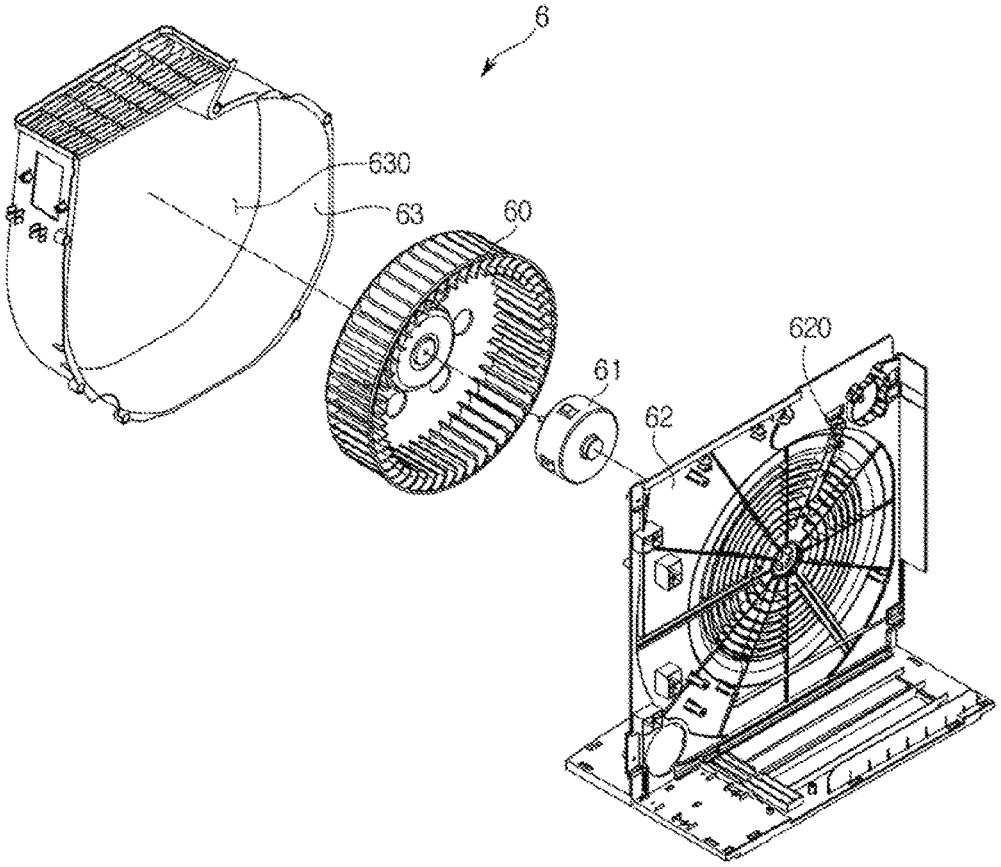

FIG. 1 is a perspective view showing a humidifying apparatus according to an embodiment of the present disclosure, FIG. 2 is a view showing the inside of a humidifying apparatus according to an embodiment of the present disclosure, FIG. 3 is exploded perspective view showing a part of a humidifying apparatus according to an embodiment of the present disclosure, and FIGS. 4A and 4B are views showing a humidifying apparatus according to an embodiment of the present disclosure.

Referring to FIGS. 1 to 4B, a humidifying apparatus 1 according to an embodiment of the present disclosure may include a housing 10 that forms the appearance, a humidifying assembly 2 that receives and vaporizes water, and a water tank 3 that is provided inside the housing 10 and stores water supplied to the humidifying assembly 2. In addition, the humidifying apparatus 1 may include a filter assembly 4 that filters water supplied from the water tank 3 and a pump 5 that pumps water stored in the water tank 3. In the housing 10, a fan assembly 6 that makes air forcibly flow may be further provided.

In the housing 10, an inflow port 12 through which air flows in and an outflow port 11 through which humidified air flows out may be provided. As an example, the outflow port 11 may be provided in an upper panel 10*a* of the housing 10. The inflow port 12 may be provided in a front panel 10*b* of the housing 10. The inflow port 12 and the outflow port 11 may be provided in the form of a grill.

The humidifying assembly 2, the water tank 3, the filter assembly 4, and the pump 5 may be accommodated in the housing 10. The water tank 3 according to an embodiment of the present disclosure may be positioned below the humidifying assembly 2, the filter assembly 4 may be positioned at one lateral side of the humidifying assembly 2, and the pump 5 may be positioned below the humidifying assembly 2 or the filter assembly 4. A distributor 7 that causes water passing through the filter assembly 4 to be delivered to the humidifying assembly 2 may be positioned above the humidifying assembly 2.

The humidifying assembly 2 may include a humidifying pad 20 made of a high absorbency material. The humidifying pad may be made of Russell-type fabrics and thereby have a structure in which ventilation is facilitated. By water flowing in the humidifying pad 20, contaminants in the air passing through the humidifying pad 20 may be washed away and the humidity in the air may be increased.

The humidifying assembly 2 may include a humidifying pad frame 21 into which the humidifying pad 20 is mounted to be detachable. The humidifying pad frame 21 may be mounted on an upper portion of the water tank 3. The humidifying pad frame 21 and the water tank 3 may be provided to be separated from each other. As an example, the humidifying pad frame 21 and the water tank may be coupled to each other by a hook system.

A supporter (not shown) into which a dust collecting filter or a deodorizing filter capable of purifying the air is mounted may be further provided in front of the humidifying pad frame 21. Water to be supplied to the humidifying assembly 2 may be stored in the water tank. The pump 5 that pumps the water stored in the water tank 3 may be connected to the water tank 3. At the water tank 3, a supply flow passage 31 through which water is supplied to a side of the pump 5 and a residual water flow passage 33 through which the water passing through the humidifying pad 20 is recovered in the water tank 3 may be further provided. The water tank 3 may be provided to be detachable from the humidifying assembly 2 so that water may be supplemented by a user. A water supply unit (not shown) may be provided at the water tank 3, and opened and closed by a cap 30.

The water pumped by the pump 5 may flow into the filter assembly 4, and organic matter, minerals, and the like which are contained in the water may be filtered. The filter assembly 4 may include a reverse osmosis membrane (RO membrane) using a reverse osmosis method or a nanofilteration membrane (NF membrane).

The reverse osmosis membrane may be a membrane that allows water to pass through but does not allow minerals to pass through, and mainly used to remove ionic substances such as metal ions, chlorine ions, etc. The nanofilteration membrane may be used to remove calcium ions or magnesium ions contained in water, low molecular weight organic substances, odor substances, detergent, etc.

The filter assembly 4 may be an activated carbon filter. The activated carbon filter may mainly remove organic matter causing discoloration or odor in the water so that clean water may be supplied to the humidifying pad 20. The filter assembly 4 may be a UF filter. The UF filter may mainly remove bacteria and microparticles in the water so that clean water may be supplied to the humidifying pad 20.

The above-described filters may be used along or in combination thereof.

By the filter assembly 4 including the reverse osmosis membrane, the water supplied to the filter assembly 4 by the pump 5 may be filtered by a reverse osmosis method and transmitted to the humidifying pad 20 by the distributor 7, and the remaining water (hereinafter, referred to as "circulating water") that is not filtered may be recovered in the water tank 3. In this case, a circulation flow passage 32 may be provided at the water tank 3 to cause the circulating water to be recovered in the water tank 3. However, in cases of the other filters other than the filter assembly 4 including the reverse osmosis membrane, the circulating water is not generated so that a configuration of the circulation flow passage 32 may be omitted.

Hereinafter, an embodiment in which the reverse osmosis membrane is used in the filter assembly 4 will be described.

The supply flow passage 31, the circulation flow passage 32, and the residual water flow passage 33 provided at the water tank 3 may be named as a flow passage unit. A fastening unit 15 may be mounted at the flow passage unit, and an inflow unit 51 and the supply flow passage 31 each provided at the pump 5, a third flow passage 43 and the circulation flow passage 32 each provided at the filter assembly 4, and a drain flow passage 211 and the residual water flow passage 33 each provided at the humidifying pad frame 21 to be described below may communicate with one another through the fastening unit 15. The fastening unit 15 may include a first connection flow passage 151 that communicates with the supply flow passage 31, a second connection flow passage 152 that communicates with the circulation flow passage 32, and a third connection flow passage 153 that communicates with the residual water flow passage 33.

The pump 5 may be provided at a lateral side of the water tank 3. The pump 5 may include the inflow unit 51 through which water is supplied in communication with the supply flow passage 31 provided at the water tank 3 and an outflow unit 52 through which water is discharged from the pump 5. The pump 5 may deliver the water supplied through the inflow unit 51 by a pumping operation to the filter assembly 4 through the outflow unit 52.

A first flow passage 41 that communicates with the outflow unit 52 of the pump 5 may be provided at the filter assembly 4. Water flowing in through the first flow passage 41 may be filtered and flow into the distributor 7 through a second flow passage 42. The second flow passage 42 may be provided to communicate with the distributor 7. The circulating water may flow into the water tank 3 through the third flow passage 43. The third flow passage 43 may be provided to communicate with the circulation flow passage 32 of the water tank 3.

The fan assembly 6 that causes air to flow may be provided at a rear side of the humidifying assembly 2. Air inside the housing 10 may smoothly flow by the fan assembly 6, so that air may flow in through the inflow port 12 of the housing 10 and air humidified by the humidifying pad 20 may be discharged to the outside through the outflow port 11 of the housing 10.

The fan assembly 6 may include the fan 60 and a motor 61 that drives the fan 60. The fan 60 may be a sirrocco fan. The fan assembly 6 may include a mounting panel 62 onto which the motor 61 and the fan 60 are mounted. The fan assembly 6 may further include a fan cover 63 that covers a rear side of the fan assembly 6. An accommodation portion 630 into which the fan 60 is accommodated may be provided in the fan cover 63.

The fan 60 may be rotatably mounted in the mounting panel 62. A grill portion 620 may be formed in the mounting panel 62. The grill portion 620 may be provided to correspond to a position of the fan 60. Air flowing toward the fan assembly 6 through the grill portion 620 may flow toward a lateral side of the fan 60 by the fan 60. Air that is blown by the rotation of the fan 60 may be discharged to the outside of the humidifying apparatus 1 through the outflow port 11 of the housing 10.

Figure 5:
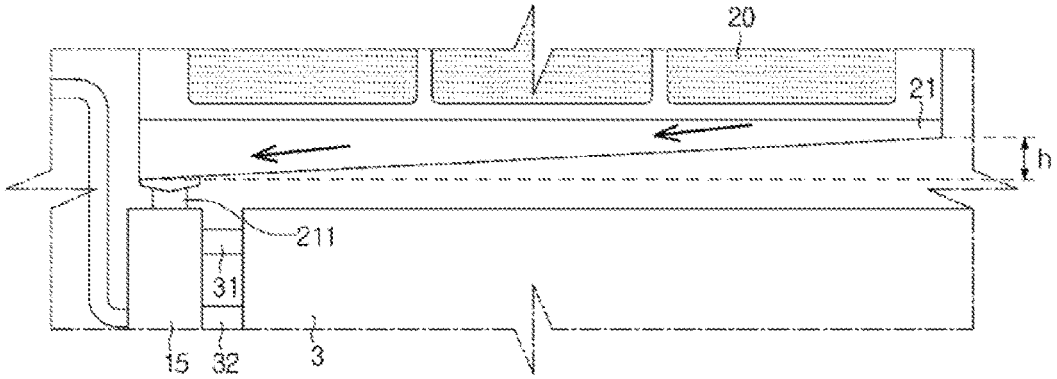
FIG. 5 illustrates a part of a humidifying apparatus according to various embodiments of the present disclosure.

FIG. 5 is a view showing a part of a humidifying apparatus according to an embodiment of the present disclosure.

Referring to FIG. 5, the drain flow passage 211 that communicates with the residual water flow passage 31 of the water tank 3 may be provided at the humidifying pad frame 21 according to an embodiment of the present disclosure. The drain flow passage 210 may communicate with the residual water flow passage 33 through the fastening unit 15.

The humidifying pad 20 may be moistened by water flowing out from the distributor 7, and water flowing out beyond the capacity that can be absorbed by the humidifying pad 20 may be collected to the water tank 3 through the drain flow passage 210 provided at a lower portion of the humidifying pad frame 21.

The drain flow passage 210 may be provided at the lower portion of the humidifying pad frame 21. The drain flow passage 210 may be provided to be biased toward one side from the center O of the humidifying pad frame 21. A lower surface of one lateral side of the humidifying pad frame 21 at which the drain flow passage 210 is provided may be provided lower than a height of a lower surface of the other lateral side of the humidifying pad frame 21.

The lower surface of the other lateral side of the humidifying pad frame 21 may be located higher by a predetermined height h than the lower surface of the one lateral side of the humidifying pad frame 21 in which the drain flow passage is provided, from a bottom surface in which the humidifying apparatus 1 is located. The lower surface of the humidifying pad frame 21 may be provided to be inclined in such a manner that the height from the bottom surface gradually increases from the one lateral side toward the other lateral side.

In this manner, the lower surface of the humidifying pad frame 21 at which the drain flow passage 210 is provided is provided to be inclined so that water that flows without being absorbed by the humidifying pad 20 may easily flow toward the drain flow passage 210 provided at the lower surface of the humidifying pad frame 21. Water passing through the drain flow passage 210 may be collected to the water tank 3 through the residual water flow passage 33.

Figure 6A:
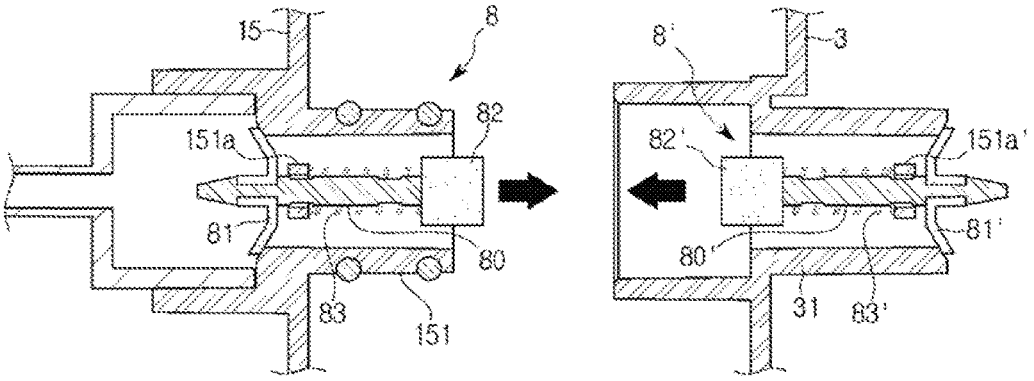
FIGS. 6A and 6B illustrate a flow passage unit according to various embodiments of the present disclosure.
Figure 6B:
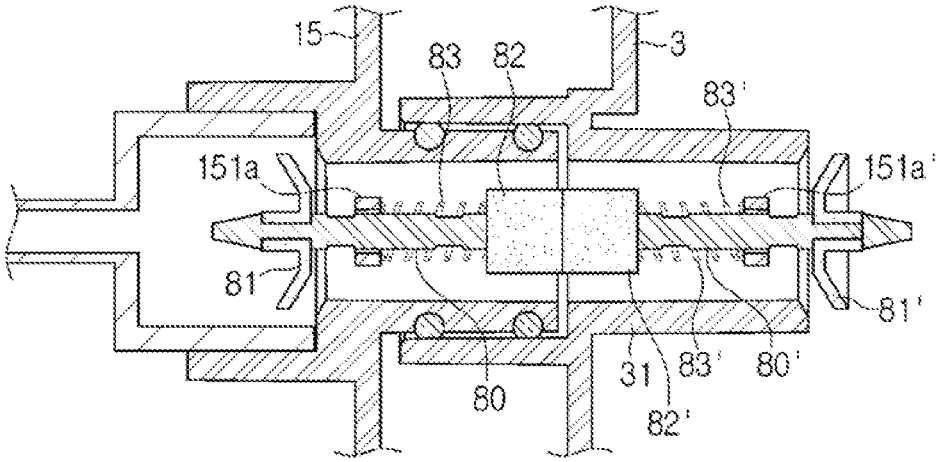

FIGS. 6A and 6B are views showing a flow passage unit according to an embodiment of the present disclosure.

Referring to FIGS. 6A and 6B, valves 8 and 8' capable of opening and closing the flow passages may be provided in the flow passages provided in the humidifying assembly 2, the water tank 3, the filter assembly 4, and the pump 5. The valves 8 and 8' may be check valves. The type of the valve may not be limited to the check valve. When the flow passages 31, 32, and 33 provided at the water tank 3 communicate with the flow passages provided at the filter assembly 4, the pump 5, and the humidifying assembly 2 through the fastening unit 15, the valves 8 and 8' for opening and closing the flow passages may be provided in the connection flow passages 151, 152, and 153 provided in the fastening unit 15.

Hereinafter, operations of the valves 8 and 8' provided in the supply flow passage 31 of the water tank 3 and the first connection flow passage 151 of the fastening unit 15 will be described.

The first valve 8 may be provided in the first connection flow passage 151 and the second valve 8' may be provided in the supply flow passage 31. When the water tank 3 is coupled to the fastening unit 15, the first valve 8 and the second valve 8' may be provided to be pressed against each other. When the first valve 8 and the second valve 8' are pressed against each other, the first connection flow passage 151 and the supply flow passage 31 may communicate with each other.

The first valve 8 may include a shaft 80, a cap 81 provided at one end of the shaft 80, an interference portion 82 provided at the other end of the shaft 80, and an elastic member 83. The elastic member 83 may be a spring. An interference portion 151*a* that extends inward may be provided inside the first connection flow passage 151. The interference portion 151*a* may be provided in the form of a ring along an inner surface of the first connection flow passage 151. The cap 81 may be provided at one side of the interference portion 151*a* and the interference portion 82 may be provided at the other side thereof while sandwiching the interference portion 151*a* therebetween. The interference portion 82 may be located to protrude toward the outside of the first connection flow passage 151 by an elastic force of the elastic member 83 as long as there is no external force.

The second valve 8' may be provided in a similar fashion as the first valve 8. The second valve 8' may include a shaft 80', a cap 81' provided at one end of the shaft 80', an interference portion 82' provided at the other end of the shaft 80', and an elastic member 83'. An interference portion 151*a* that extends inward may be provided inside the supply flow passage 31. The cap 81' may be provided at one side of the interference portion 311 and the interference portion 82' may be provided at the other side thereof while sandwiching the interference portion 311 therebetween. The interference portion 82' may be located to protrude toward the outside of the supply flow passage 31 by an elastic force of the elastic member 83' as long as there is no external force.

When the water tank 3 is coupled to the fastening unit 15, the interference portion 82 of the first valve 8 provided in the fastening unit 15 and the interference portion 82' of the second valve 8' provided in the supply flow passage 31 may be pressed against each other. By the interference portions 82 and 82' being pressed against each other, the first valve 8 may move in one direction and the second valve 8' may move in the other direction so that the caps 81 and 81' may respectively open the first connection flow passage 151 and the supply flow passage 31. Accordingly, the first connection flow passage 151 and the supply flow passage 31 may communicate with each other. When the water tank 3 is separated from the fastening unit 15, the first valve 8 may move in the other direction and the second valve 8' may move in one direction by the elastic force of the elastic members 83 and 83' so that the caps 81 and 81' may respectively shut off the first connection flow passage 151 and the supply flow passage 31.

In the description above, the valves provided in the supply flow passage 31 and the first connection flow passage 151 have been described, but this can be similarly applied to the other flow passages. The type of the valve provided in the flow passage is not limited to the above description.

Figure 7:
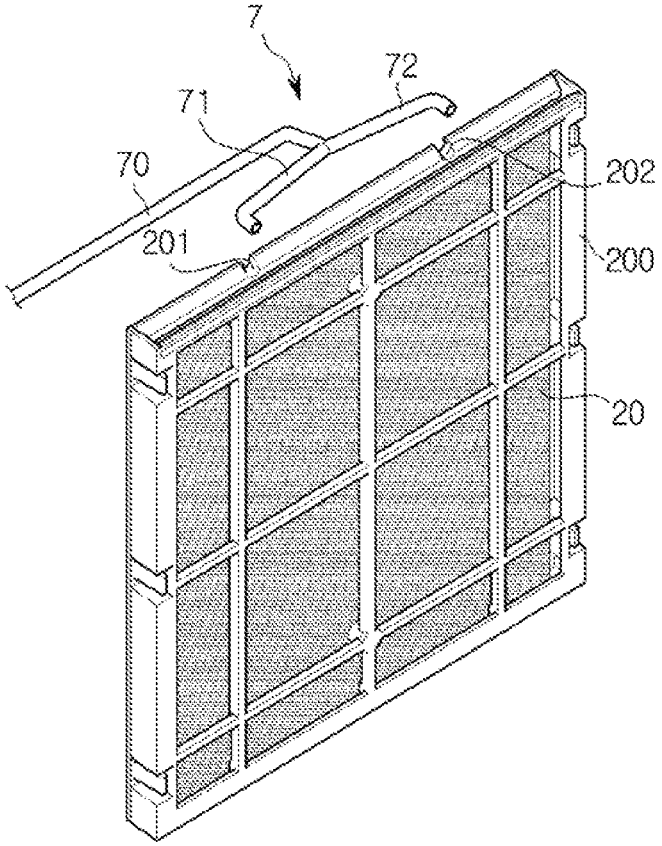
FIG. 7 illustrates a distributor according to various embodiments of the present disclosure.

FIG. 7 is a view showing a distributor according to an embodiment of the present disclosure.

Referring to FIG. 7, the distributor 7 according to an embodiment of the present disclosure may be located above the humidifying pad 20. The distributor 7 includes a first distribution flow passage 70 that is connected to the second flow passage 42 provided at the filter assembly 4. The first distribution flow passage 70 may be branched into a plurality of flow passages. As an example, the first distribution flow passage 70 may be branched into a second distribution flow passage 71 and a third distribution flow passage 72.

The humidifying pad 20 may be inserted into a fixing frame 200 and detachably mounted in the humidifying pad frame 21. Seating portions 201 and 202 on which the second distribution flow passage 71 and the third distribution flow passage 72 are seated may be provided in an upper portion of the fixing frame 200. The seating portions 201 and 202 may be provided in the form of a seating groove on which each of the second distribution flow passage 71 and the third distribution flow passage 72 can be seated.

Figure 8:
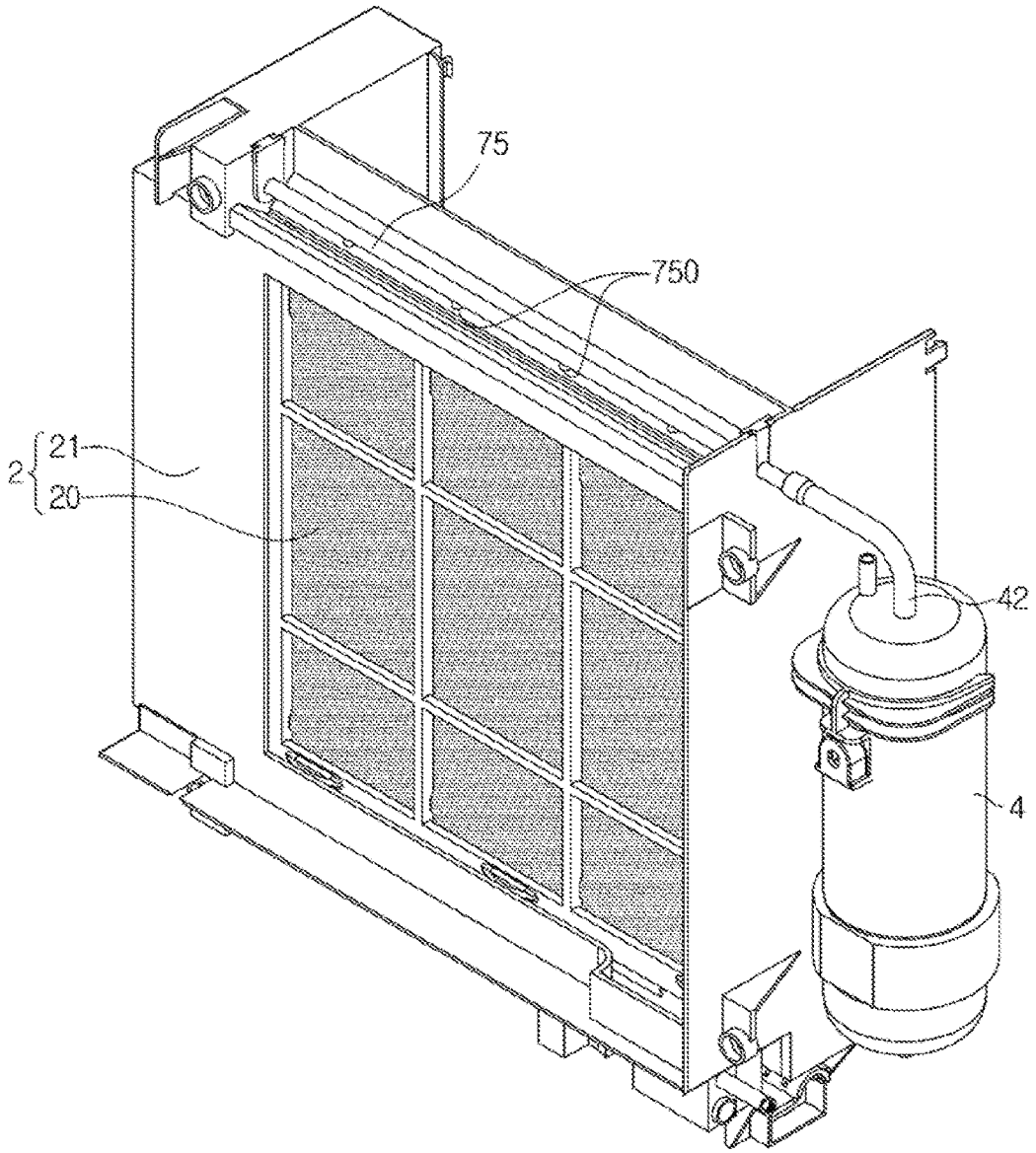
FIG. 8 illustrates a distributor according to various embodiments of the present disclosure.
Figure 9A:
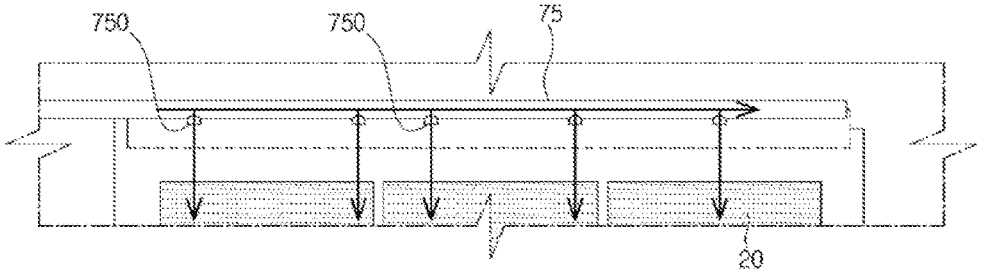
FIG. 9A illustrates a part of a distributor according to various embodiments of the present disclosure.

FIG. 8 is a view showing a distributor according to another embodiment of the present disclosure, and FIG. 9A is a view showing a part of a distributor according to another embodiment of the present disclosure.

Referring to FIGS. 8 and 9A, the distributor according to another embodiment of the present disclosure may be provided in the form of a distribution pipe 75. The distribution pipe 75 may be seated on the humidifying pad frame 21 and spray water to the humidifying pad 20. One side of the distribution pipe 75 may be connected to the second flow passage 42 of the filter assembly 4 and receive filtered water. A plurality of spray holes 750 may be formed in the distribution pipe 75. Water filtered by the filter assembly 4 may be sprayed to the humidifying pad 20 via the plurality of spray holes 750.

Assuming that a direction in which an end of one side of the distribution pipe 75 that is spaced apart from the second flow passage 42 connected to the filter assembly 4 is positioned is referred to a first direction and a direction in which an end of the other side thereof that is connected to the second flow passage 42 is positioned is referred to as a second direction, a height of the distribution pipe 75 from the bottom surface may increase from the first direction toward the second direction. Accordingly, water may be prevented from being intensively sprayed through the spray holes 750 provided close to the second flow passage 42.

The entire area of the plurality of spray holes 750 formed in the distribution pipe 75 may be formed smaller than an area of one end surface of the distribution pipe 75. Accordingly, water supplied via the distribution pipe 75 at a predetermined pressure may be sprayed via the plurality of spray holes 750 at a larger water pressure.

Figure 9B:
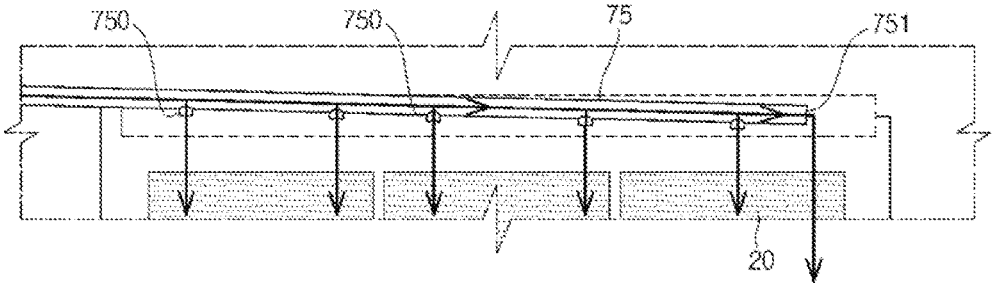
FIG. 9B illustrates a part of a distributor according to various embodiments of the present disclosure.

FIG. 9B is a view showing a part of a distributor according to still another embodiment of the present disclosure.

Referring to FIG. 9B, the distributor according to still another embodiment of the present disclosure includes a distribution pipe 75. A distribution hole 751 may be provided at an end of the distribution pipe 75. That is, the end of the distribution pipe 75 may be opened without being closed. A plurality of spray holes 750 may be formed in the distribution pipe 75 as shown in FIG. 9A.

Since the spray hole 750 is provided to have a relatively small diameter, there may occur a case in which the spray hole 750 is clogged by foreign matter or the like during the use of the humidifying apparatus 1. When the spray hole 750 is clogged, water filtered by the filter assembly 4 cannot be sprayed to the humidifying pad 20 so that the pressure inside the distribution pipe 75 may increase and water may not flow out smoothly, which may cause a failure in the pump 5 or the filter assembly 4.

In the distributor according to still another embodiment of the present disclosure, even when the spray hole 750 is clogged during the use of the humidifying apparatus 1, water filtered by the filter assembly 4 may be supplied to the humidifying pad 20 via the distribution hole 751 formed at the end of the distribution pipe 75. Accordingly, a humidifying operation may be smoothly performed, and the occurrence of a failure in the distributor, the filter assembly 4, the pump 5, or the like may be prevented.

Figure 10:
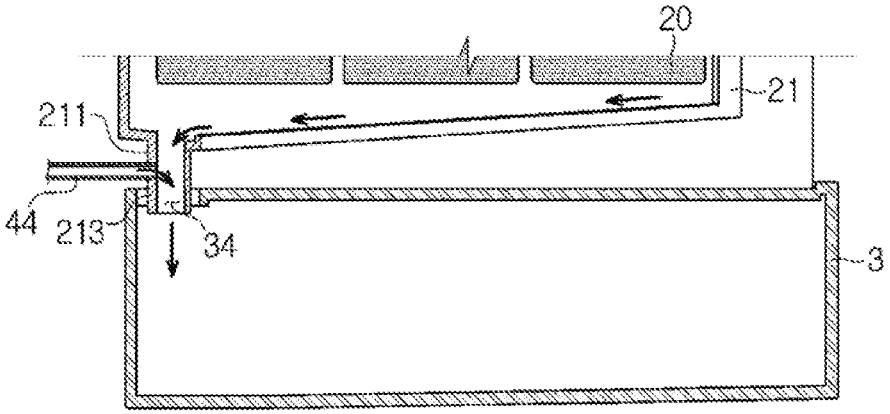
FIG. 10 illustrates a flow passage unit according to various embodiments of the present disclosure.

FIG. 10 is a view showing a flow passage unit according to another embodiment of the present disclosure.

Referring to FIG. 10, a drain flow passage 211 of the humidifying pad frame 21 and the third flow passage 43 of the filter assembly 4 according to another embodiment of the present disclosure may be connected to the water tank 3 through a merging flow passage 213. The drain flow passage 211 may be positioned at one side of a lower portion of the humidifying pad frame 21, and the third flow passage 43 may be provided to communicate with a residual water flow passage 211.

Water sprayed to the humidifying pad 20 may be absorbed by the humidifying pad 20 and the residual water that cannot be absorbed by the humidifying pad 20 may be discharged via the drain flow passage 211 positioned at the lower portion of the humidifying pad frame 21. Water stored in the water tank 3 may be pumped by the pump 5 and flow into the filter assembly 4, and water filtered by the filter assembly 4 may flow to the distributor 7 via the second flow passage 42. Circulating water of the filter assembly 4 may be discharged via the third flow passage 43.

The drain flow passage 211 and the third flow passage 44 may be merged into the single merging flow passage 213. The residual water discharged via the drain flow passage 211 and the circulating water discharged via the third flow passage 43 may flow into the water tank 3 via the single merging flow passage 213.

Figure 11A:
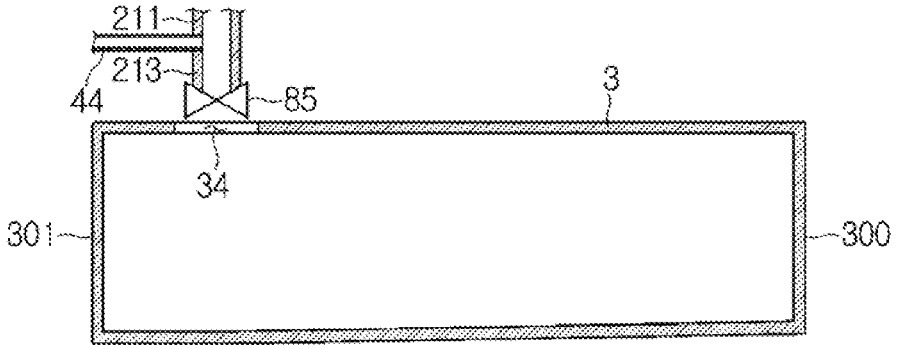
FIGS. 11A and 11B illustrate a merging flow passage of a water tank according to various embodiments of the present disclosure.
Figure 11B:
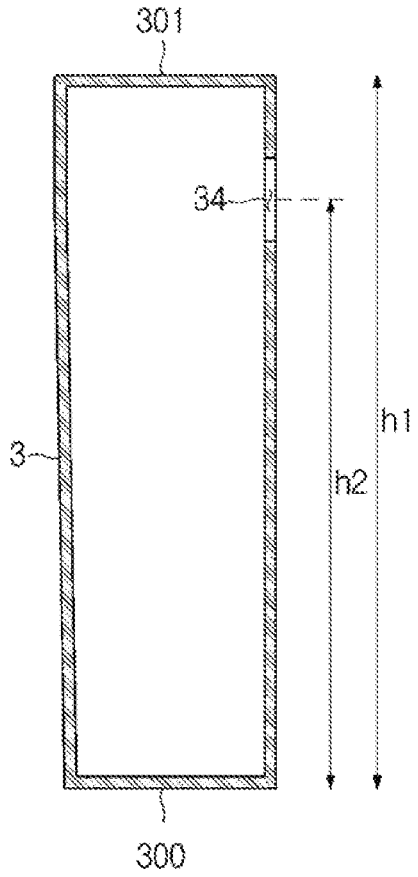

FIGS. 11A and 11B are views showing a merging flow passage of a water tank according to an embodiment of the present disclosure.

Referring to FIGS. 11A and 11B, an inlet hole 34 may be formed in the upper portion of the water tank 3. Water flowing via the merging flow passage 213 shown in FIG. 10 may flow into the water tank 3 via the inlet hole 34. When the drain flow passage 211 and the third flow passage 44 are not merged, the residual water discharged via the drain flow passage 211 may flow into the water tank 3 via the inlet hole 34.

Water flowing in the merging flow passage 213 or the drain flow passage 211 may flow into the water tank 3 by a free fall system. The water flowing in the merging flow passage 213 or the drain flow passage 211 may also flow into the water tank 3 by being pumped by a pump (not shown).

The inlet hole 34 may be positioned to be biased toward one side from the center of the upper surface of the water tank 3. Assuming one side surface of the water tank 3 is referred to as a first surface 300 and the other surface thereof facing the first surface 300 is referred to as a second surface 301, the inlet hole 34 may be positioned closer to the second surface 301 than the first surface 300.

The inlet hole 34 may be positioned in such a manner that a length h2 from the first surface 300 to the inlet hole 34 is 70% or more of a length h1 from the first surface 300 to the second surface 301. Accordingly, when the water tank 3 is upright with the first surface 300 thereof positioned at the bottom, at least 70% of the capacity of the water tank 3 may be filled with water.

A valve 85 that can be opened and closed may be provided at the inlet hole 34. Only when the merging flow passage 213 in which the drain flow passage 211 and the third flow passage 43 are merged is connected to the inlet hole 34 of the water tank 3, the valve 85 may be opened.

Figure 12A:
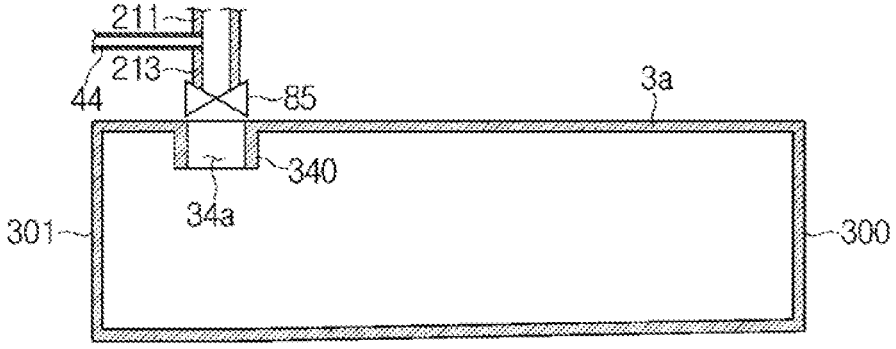
FIGS. 12A and 12B illustrate an internal flow passage of a water tank according to various embodiments of the present disclosure.
Figure 12B:
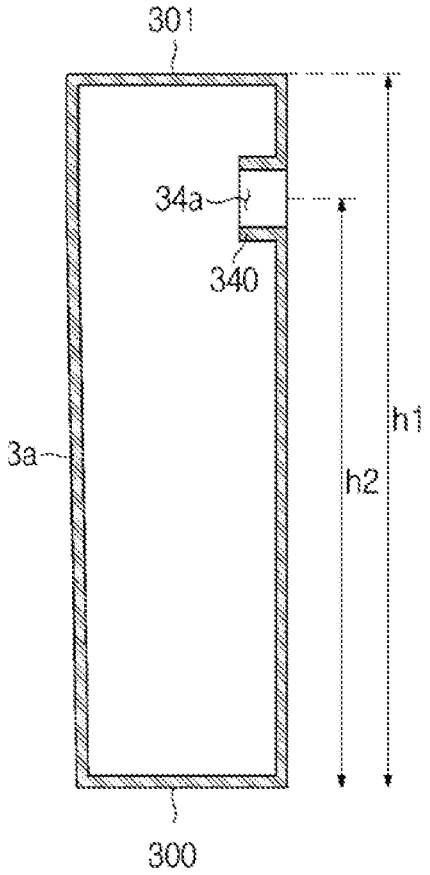

FIGS. 12A and 12B are views showing an internal flow passage of a water tank according to an embodiment of the present disclosure.

Referring to FIGS. 12A and 12B, an inlet hole 34*a* may be formed in an upper surface of the water tank 3*a*, and an internal flow passage 340 communicating with the inlet hole 34*a* may be provided. The internal flow passage 340 may extend to the interior of the water tank 3. The internal flow passage 340 may extend from the inlet hole 34*a* so as to face a bottom portion of the water tank 3.

The inlet hole 34*a* may be provided to communicate with the drain flow passage 211 or the merging flow passage 213. The drain flow passage 211 and the third flow passage 44 may pass through the inlet hole 34*a* and be merged with the internal flow passage 340 positioned in the interior of the water tank 3.

Figure 13A:
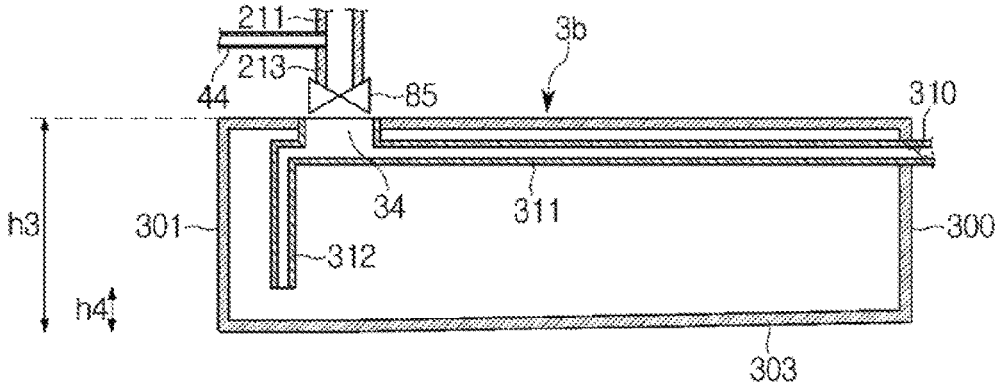
FIGS. 13A and 13B illustrate a supply flow passage of a water tank according to various embodiments of the present disclosure.
Figure 13B:
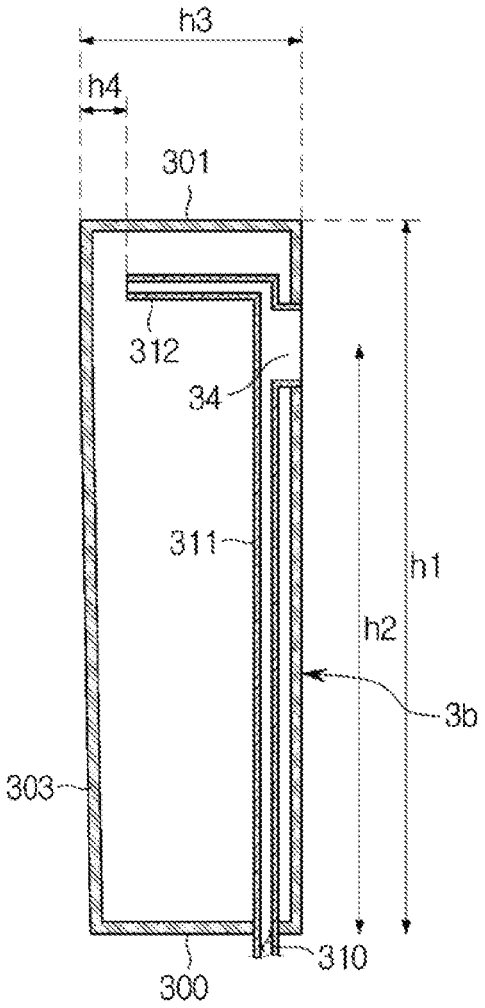

FIGS. 13A and 13B are views showing a supply flow passage of a water tank according to an embodiment of the present disclosure.

Referring to FIGS. 13A and 13B, a supply flow passage 31 that communicates with the inflow unit 51 of the pump 5 may be provided in a water tank 3*b*. The supply flow passage 31 may include a supply hole 310 that is formed at one side of the water tank 3*b*, a first supply flow passage 311 that communicates with the supply hole 310, and a second supply flow passage 312 that is provided to be bent from the first supply flow passage 311.

The first supply flow passage 311 and the second supply flow passage 312 may be positioned in the interior of the water tank 3*b*. The first supply flow passage 311 may be positioned in an upper portion of the interior of the water tank 3*b*, and the second supply flow passage 312 may be provided to be bent from the first supply flow passage 311 toward the bottom portion 303 of the water tank 3*b*.

The first supply flow passage 311 or the second supply flow passage 312 may be provided to communicate with the inlet hole 34 or 34*a*. The drain flow passage 211, the third flow passage 44 or the merging flow passage 213 that communicates with the inlet hole 34 or 34*a* may be provided to communicate with the first supply flow passage 311 or the second supply flow passage 312. In this case, the first supply flow passage 311 may extend up to a position in which the inlet hole 34 or 34*a* are formed. A length from the first surface 300 to the second supply flow passage 312 may be the same as or longer than a length from the first surface 300 to the inlet hole 34 or 34*a*.

The first supply flow passage 311 may be positioned in an upper portion of the water tank 3*b* so as to be positioned parallel to the bottom portion 303 of the water tank 3*b*. A height h4 from the bottom portion 303 of the water tank 3*b* to an end of the second supply flow passage 312 may be within a range of 1/10 to 1/4 of a height h3 from the bottom surface of the water tank 3*b* to the upper surface thereof.

The concentration of organic matter, minerals, and the like of the water stored in the water tanks 3, 3*a*, and 3*b* may increase depending on the use of the humidifying apparatus 1. In this manner, the height h4 of the end of the second supply flow passage 312 may be provided to be spaced apart from the bottom surface of the water tank 3*b* by a predetermined distance, so that water with organic matter, minerals, and the like highly concentrated therein to be supplied to the pump 5 may be prevented from being used when the humidifying apparatus 1 is operated.

Figure 14A:
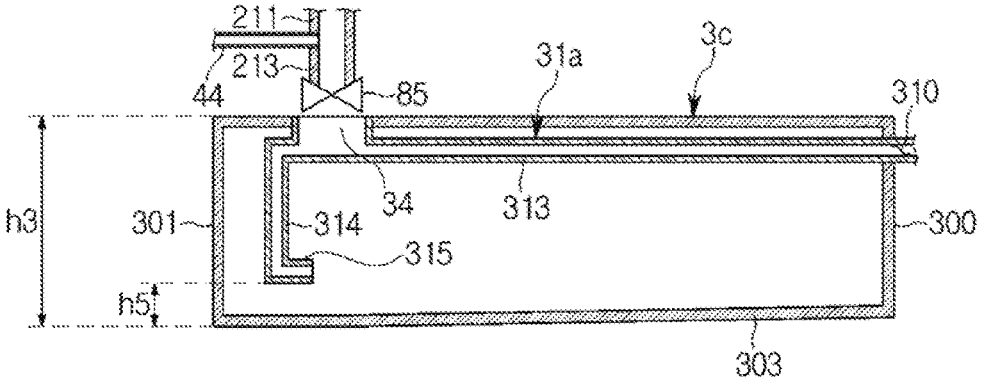
FIGS. 14A and 14B illustrate a supply flow passage of a water tank according to another embodiment of the present disclosure.
Figure 14B:
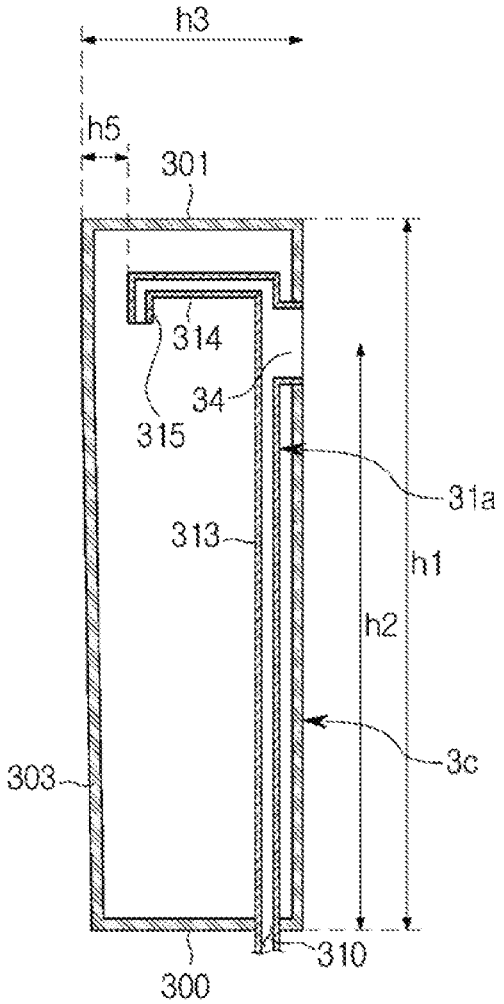

FIG. 14 is a view showing a supply flow passage of a water tank according to another embodiment of the present disclosure.

Referring to FIG. 14, a supply flow passage 31*a* of a water tank 3*c* according to another embodiment of the present disclosure may include a first supply flow passage 313 that communicates with a supply hole 310*a*, a second supply flow passage 314 that is provided to be bent from the first supply flow passage 313, and a third supply flow passage 315 that is provided to be bent from the second supply flow passage 314.

The first supply flow passage 313 and the second supply flow passage 314 may be configured similarly to the first supply flow passage 311 and the second supply flow passage 312 shown in FIG. 13. Specifically, the first supply flow passage 313 and the second supply flow passage 314 may be positioned in the interior of the water tank 3*c*. The first supply flow passage 313 may be positioned in an upper portion of the interior of the water tank 3*b*, and the second supply flow passage 314 may be provided to be bent from the first supply flow passage 313 toward the bottom portion 303.

The first supply flow passage 313 or the second supply flow passage 314 may be provided to communicate with the inlet hole 34 or 34*a*, and the drain flow passage 211, the third flow passage 44 or the merging flow passage 213 each communicating with the inlet hole 34 or 34*a* may be provided to communicate with the first supply flow passage 313 or the second supply flow passage 314. A length from the first surface 300 to the second supply flow passage 314 may be the same as or longer than a length from the first surface 300 to the inlet hole 34 or 34*a*.

The third supply flow passage 315 may be bent from the second supply flow passage 314 toward one side surface of the water tank 3*c*. The third supply flow passage 315 may be provided to extend parallel to the bottom portion 303 of the water tank 3*c*. A height h5 from the bottom portion 303 of the water tank 3*c* to the third supply flow passage 315 may be within a range of 1/10 to 1/4 of a length h3 from the bottom portion 303 to the upper surface of the water tank 3*c*. Accordingly, water with organic matter, minerals, and the like highly concentrated therein to be supplied to the pump 5 may be prevented from being used when the humidifying apparatus 1 is operated.

Figure 15:
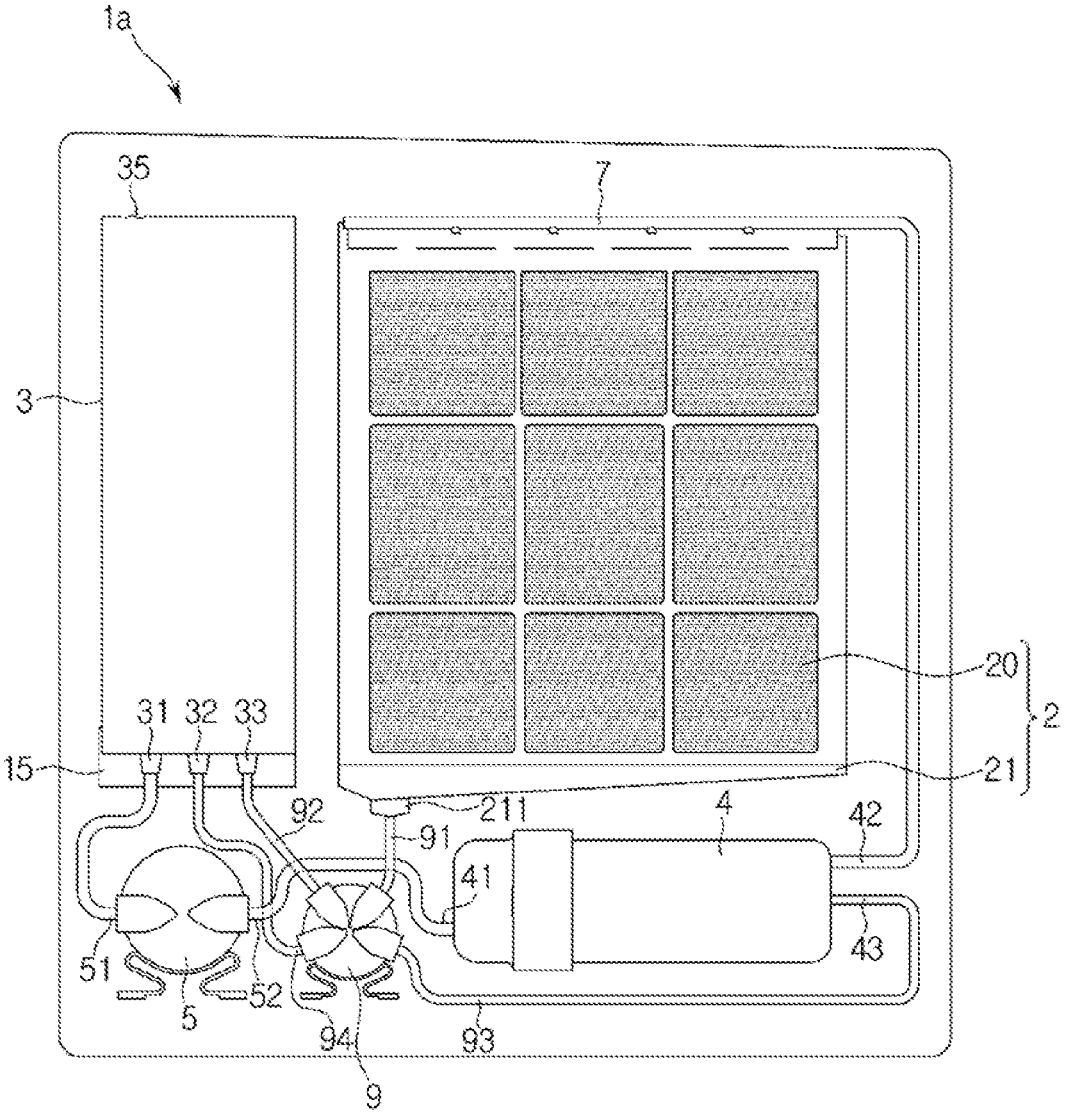
FIG. 15 illustrates a humidifying apparatus according to another embodiment of the present disclosure.

FIG. 15 is a view showing a humidifying apparatus according to another embodiment of the present disclosure.

Referring to FIG. 15, in a humidifying apparatus 1*a* according to another embodiment of the present disclosure, the water tank 3 may be positioned at a side surface of the humidifying pad 20. The supply flow passage 31, the circulation flow passage 32, and the residual water flow passage 33 may be positioned below the water tank 3.

A vent hole 35 may be provided at one side of the water tank 3. By the formation of the vent hole 35, water stored in the water tank 3 may easily flow through the flow passage unit. As an example, the vent hole 35 may be formed in the upper surface of the water tank 3.

Water that is drained via the drain flow passage 211 formed at the humidifying pad frame 21 may be pumped by a recovery pump 9 and flow into the water tank 3.

The drain flow passage 211 and the recovery pump 9 may be connected to each other by a first recovery flow passage 91, and the recovery pump 9 and the water tank 3 may be connected to each other by a second recovery flow passage 92. Water that is drained from the humidifying pad frame 21 may be pumped by the recovery pump 9 and flow into the water tank 3 via the drain flow passage 211, the first recovery flow passage 91, the recovery pump 9, the second recovery flow passage 92, and the residual water flow passage 33.

The filter assembly 4 may be positioned below the humidifying assembly 2. The first flow passage 41 of the filter assembly 4 may be connected to the outflow unit 52 of the pump 5 and supplied with water. The second flow passage 42 may be connected to the distributor 7 so that water filtered by the filter assembly 4 may be sprayed to the humidifying pad 20 through the distributor 7. The third flow passage 43 may be connected to the recovery pump 9. The third flow passage 43 may be connected to the recovery pump 9 through a third recovery flow passage 93. The recovery pump 9 and the circulation flow passage 32 provided in the water tank 3 may be connected to each other by a fourth recovery flow passage 94. Circulating water may be pumped by the recovery pump 9 and flow into the water tank 3 via the third flow passage 43, the third recovery flow passage 93, the recovery pump 9, the fourth recovery flow passage 94, and the circulation flow passage 32.

When the water tank 3 is provided at the side surface of the humidifying assembly 2 in this manner, residual water flowing down from the humidifying pad 20 by the recovery pump 9 may flow into the water tank 3 again. In addition, the circulating water discharged from the filter assembly 4 may flow into the water tank 3 by the recovery pump 9.

The fastening unit 15 may be provided at one side on which the supply flow passage 31, the circulation flow passage 32, and the residual water flow passage 33 of the water tank 3 are provided. The supply flow passage 31, the circulation flow passage 32, the residual water flow passage 33 may be respectively connected to the inflow unit 51, the fourth recovery flow passage 94, and the second recovery flow passage 92 through the fastening unit 15.

Figure 16:
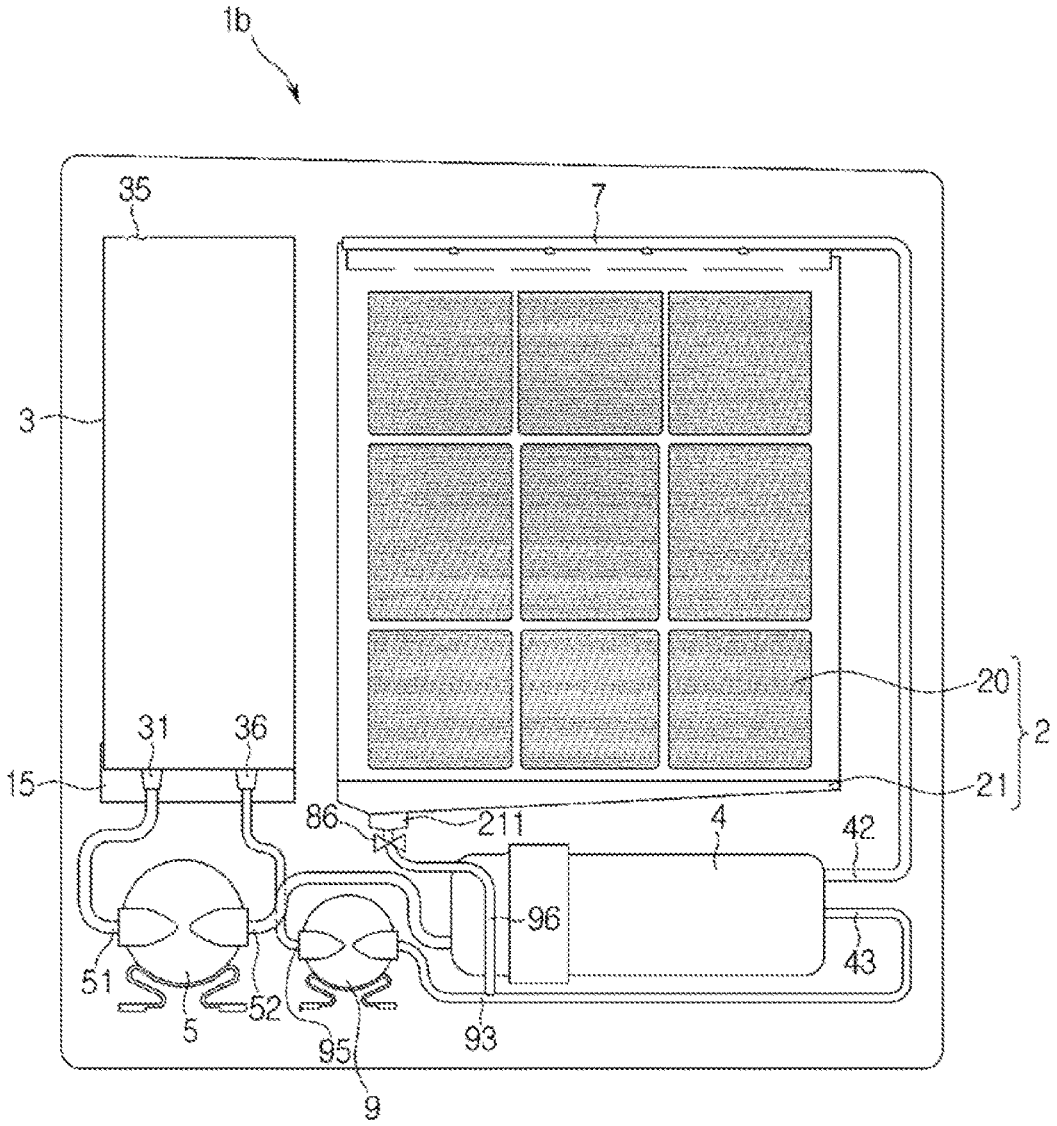
FIG. 16 illustrates a humidifying apparatus according to still another embodiment of the present disclosure.

FIG. 16 is a view showing a humidifying apparatus according to still another embodiment of the present disclosure.

Referring to FIG. 16, in a humidifying apparatus 1*b* according to still another embodiment of the present disclosure, the water tank 3 may be positioned at a side surface of the humidifying assembly 2, and the circulation flow passage and the residual water flow passage provided at the water tank 3 may be provided as one. Hereinafter, a flow passage in which the circulation flow passage and the residual water flow passage are provided as one is referred to as an inflow flow passage 36.

The circulation flow passage and the residual water flow passage may be provided as one so that the second recovery flow passage 92 and the fourth recovery flow passage 94 shown in FIG. 14 may be provided as one. A flow passage whose one side communicates with the inflow flow passage 36 and the other side is connected to the recovery pump 9 may be referred to as a fifth recovery flow passage 95.

A sixth recovery flow passage 96 may be connected to the drain flow passage 211, and the drain flow passage 211 may be connected to the third recovery flow passage 93 through the sixth recovery flow passage 96. The drain flow passage 211 may be directly connected to the recovery pump 9 through the sixth recovery flow passage 96. A valve 86 may be provided at the drain flow passage 211 or the sixth recovery flow passage 96 so that circulating water flowing in the third recovery flow passage 93 may be prevented from flowing backward.

In this manner, the circulation flow passage and the residual water flow passage each provided in the water tank 3 are provided as one so that the structure of the flow passage may be simplified.

Figure 17:
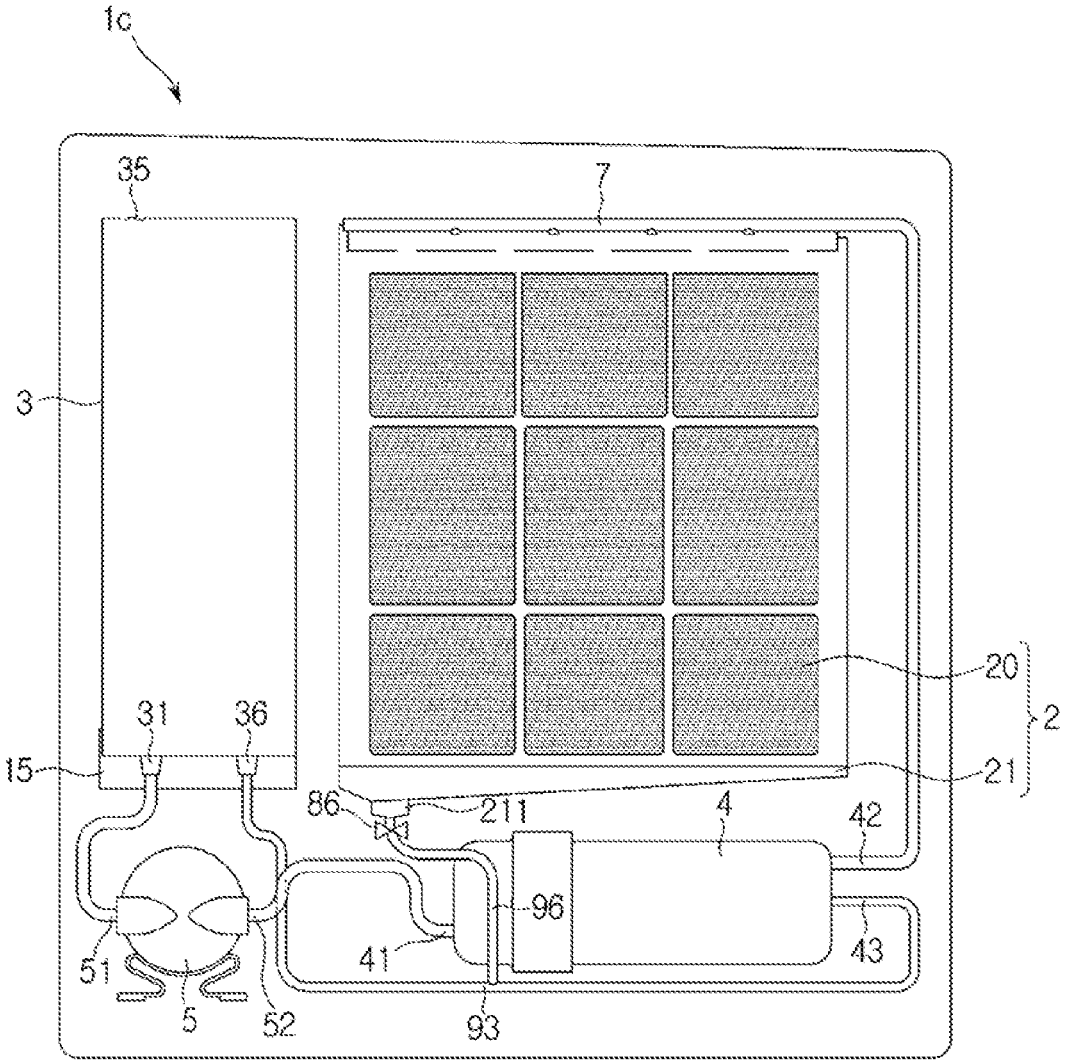
FIG. 17 illustrates a humidifying apparatus according to yet another embodiment of the present disclosure.

FIG. 17 is a view showing a humidifying apparatus according to yet another embodiment of the present disclosure.

Referring to FIG. 17, in a humidifying apparatus 1*c* according to yet another embodiment of the present disclosure, the water tank 3 may be provided at a lateral side of the humidifying assembly 2, and the inflow flow passage 36 in which the circulation flow passage connected to the filter assembly 4 to cause circulating water to flow in and the residual water flow passage connected to the drain flow passage 211 of the humidifying assembly 2 are provided as one may be provided. The recovery pump 9 shown in FIGS. 15 and 16 may be omitted.

The drain flow passage 211 may be connected to the third flow passage 43 of the filter assembly 4. A valve 86 may be provided at the drain flow passage 211, thereby preventing circulating water flowing in the third flow passage 43 from flowing backward. The drain flow passage 211 may be directly connected to the inflow flow passage 36.

In this case, the structure of the flow passage connected to the water tank 3 may be simplified.

Figure 18:
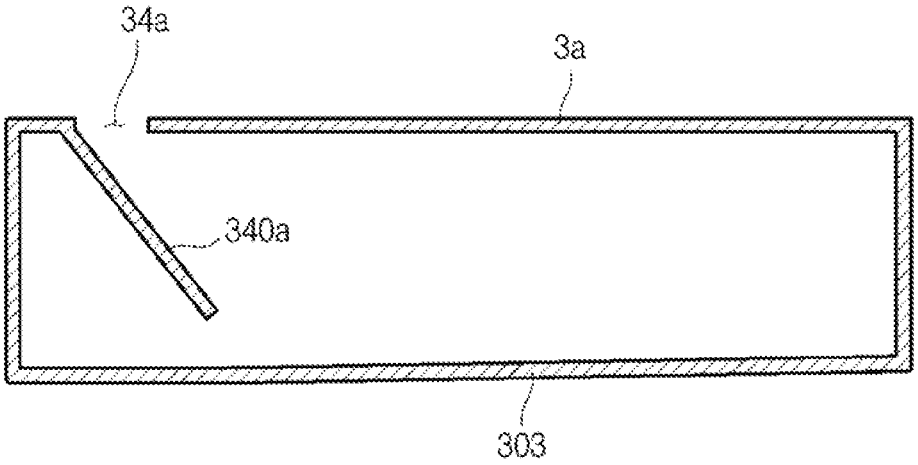
FIG. 18 illustrates an internal flow passage of a water tank according to still another embodiment of the present disclosure.

FIG. 18 is a view showing an internal flow passage of a water tank according to still another embodiment of the present disclosure.

Referring to FIG. 18, inside a water tank 3*a* according to still another embodiment of the present disclosure, a guide rib 340*a* that extends from the inlet hole 34*a* may be provided. The guide rib 340*a* may guide water flowing-in via the inlet hole 34*a* to fall into the water tank 3*a*.

The guide rib 340*a* may extend obliquely toward the bottom portion 303 of the water tank 3*a* from the inlet hole 34*a*. The extending direction of the guide rib 340*a* may form an acute angle with the inner bottom portion 303 of the water tank 3*a*. An angle θ formed between the guide rib 340*a* and the bottom surface 303 may be smaller than 90°. The guide rib 340*a* may extend to be adjacent to the bottom portion 303. The guide rib 340*a* may extend from the inlet hole 34*a* and extend up to the bottom portion 303.

Water flowing without being absorbed by the humidifying pad 20 may flow into the water tank 3*a* via the inlet hole 34*a* from the lower portion of the humidifying assembly 2. At this time, the water that cannot be absorbed by the humidifying pad 20 may flow into the water tank 3*a* via the drain flow passage or directly flow into the inlet hole 34*a* from the lower portion of the humidifying assembly 2.

Assuming the guide rib 340*a* is not provided, when water falls from the inlet hole 34*a*, noise may occur caused by water falling to the bottom portion 303 of the water tank 3*a*. The guide rib 340*a* may prevent noise that occurs when water flowing-in via the inlet hole 34*a* falls. Accordingly, noise that may occur when the humidifying apparatus 1 is operated may be reduced.

Figure 19A:
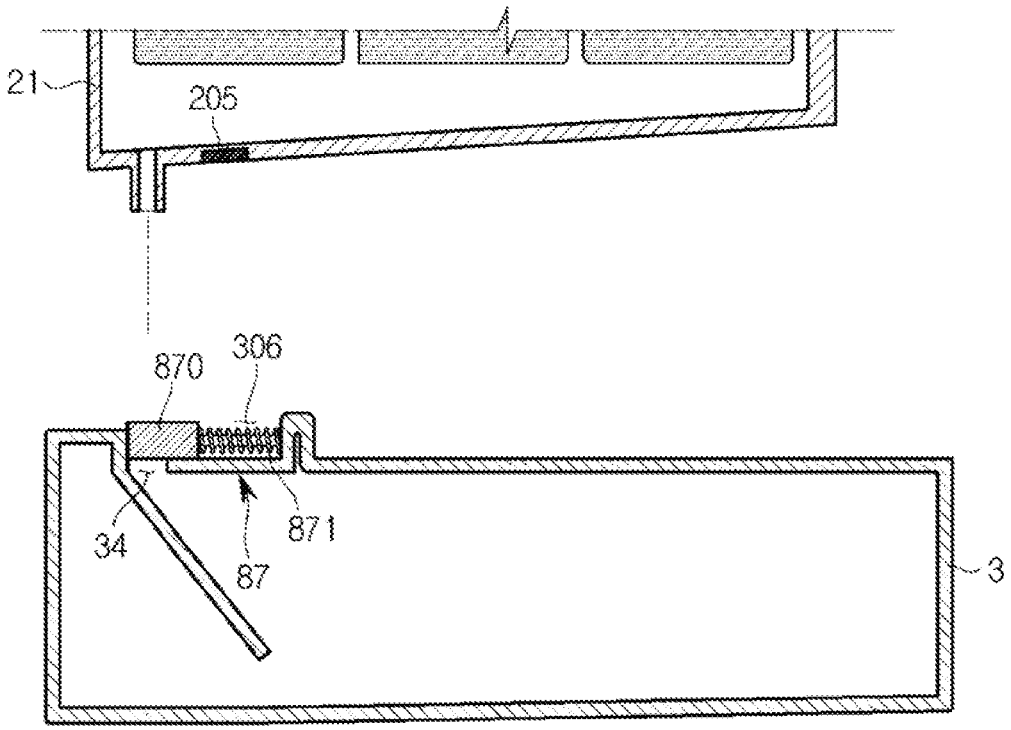
FIGS. 19A and 19B illustrate an opening and closing unit of a water tank according to various embodiments of the present disclosure.
Figure 19B:
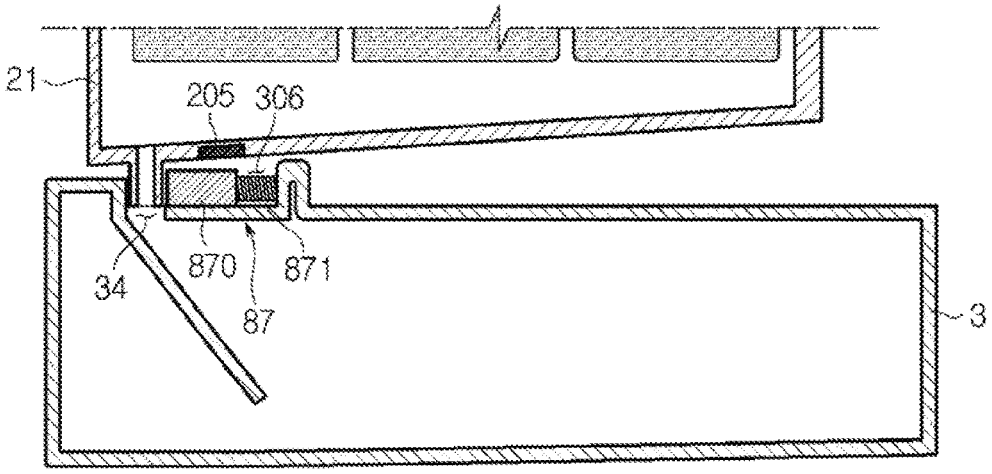

FIGS. 19A and 19B are views showing an opening and closing unit of a water tank according to an embodiment of the present disclosure.

Referring to FIGS. 19A and 19B, the inlet hole 34 that causes water flowing without being absorbed by the humidifying pad 20 to flow into the water tank 3 may be formed at one side of the water tank 3 according to an embodiment of the present disclosure. The inlet hole 34 may be provided to be capable of being opened and closed by the opening and closing unit 87. The inlet hole 34 may be formed in the upper surface of the water tank 3 so that the water flowing without being absorbed by the humidifying pad 20 may directly fall into the water tank 3.

When the water tank 3 is separated from the humidifying apparatus 1, the inlet hole 34 may be covered by the opening and closing unit 87, and when the water tank 3 is mounted in the humidifying apparatus 1, the inlet hole 34 may be opened. In this manner, the inlet hole 34 is opened only when the water tank 3 is mounted in the humidifying apparatus 1 so that water in the water tank 3 may be prevented from being leaked when the water tank 3 is separated and moved due to a reason such as replacement of water in the water tank 3 or the like.

The opening and closing unit 87 may be provided to automatically open and close the inlet hole 34 by a magnetic force. As an example, a magnet 205 may be disposed in the lower portion of the humidifying pad frame 21, and a plunger 870 that is movable by the magnet 205 may be provided above the water tank 3. The plunger 870 may be made of a metallic material on which an attractive force with the magnet 205 disposed in the humidifying pad frame 21 is exerted. An accommodation space 306 in which the plunger 870 can be accommodated may be provided at the upper portion of the water tank 3.

The plunger 870 may be provided to receive an elastic force from an elastic member 871. The inlet hole 34 may be kept closed by the plunger 870 using the elastic force of the elastic member 871 as long as there is no external force. That is, when the water tank 3 is separated from the humidifying apparatus 1, the plunger 870 may close the inlet hole 34, thereby preventing water in the water tank 3 from being leaked.

When the water tank 3 is mounted in the humidifying apparatus 1, the plunger 870 may be moved in a direction of facing the elastic force of the elastic member 871 by the attractive force between the magnet 205 mounted in the humidifying pad frame 21 and the plunger 870, so that the inlet hole 34 may be opened.

As described above, a structure in which the inlet hole 34 is opened and closed by the opening and closing unit 87 has been described, but the structure of the opening and closing unit 87 may be similarly applied even to a hole formed in the water tank 3 so as to communicate with the supply flow passage, the drain flow passage, or the residual water flow passage.

Figure 20:
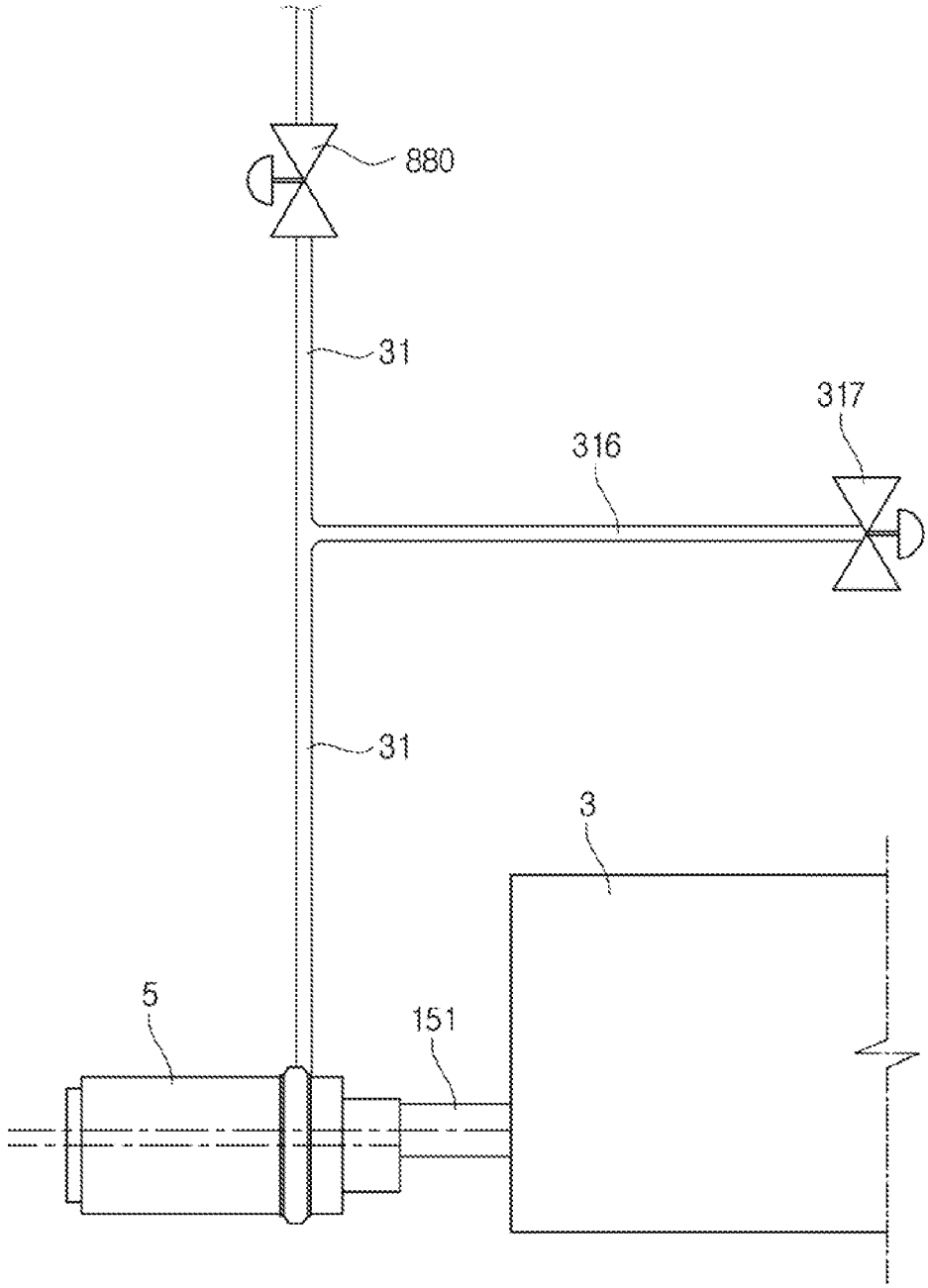
FIG. 20 illustrates a flow passage unit that extends from a pump according to various embodiments of the present disclosure.

FIG. 20 is a view showing a flow passage unit that extends from a pump according to an embodiment of the present disclosure.

Referring to FIG. 20, a valve 880 capable of opening and closing the supply flow passage 31 may be provided in the supply flow passage 31 connected to the pump 5 according to an embodiment of the present disclosure. A vent flow passage 316 may be provided to be branched from the supply flow passage 31. The vent flow passage 316 may be opened and closed by a vent valve 317.

When the vent flow passage 316 is opened by the vent valve 317, the inside and outside of the supply flow passage 31 may communicate with each other so that air is allowed to flow in and out. When the vent flow passage 316 is closed by the vent valve 317, the inside of the supply flow passage 31 may be disconnected from the outside and thereby become a closed space.

When water pumped by the pump 5 flows in the supply flow passage 31, the vent flow passage 316 may be closed by the vent valve 317 so as to prevent water flowing in the supply flow passage 31 from being leaked. Before the water is pumped by the pump 5, the vent flow passage 316 may be opened to make the internal and external pressure of the supply flow passage 31 equal to each other.

This is because the pump 5 may idle when the water tank 3 is separated in a state in which the operation of the pump 5 is not stopped or when water in the water tank 3 is insufficient or absent and air may flow into the supply flow passage 31 by the idling of the pump 5. Assuming air flows into the supply flow passage 31, when the pump 5 is operated, noise may occur and a pumping operation by the pump 5 may not be smoothly performed.

Accordingly, before the operation of the pump 5, air inside the supply flow passage 31 may flow out to the outside by opening the vent valve 317 in such a manner that the internal pressure and external pressure of the supply flow passage 31 may be made equal to each other, and therefore the pumping operation by the pump 5 may be smoothly performed.

Meanwhile, the pump 5 may be connected to the water tank 3 via a connection flow passage, and the supply flow passage 31 may be connected to the pump 5. The vent flow passage 316 may be provided to be branched from the supply flow passage 31. The vent valve 317 may be provided in the vent flow passage 316 to be capable of opening and closing the vent flow passage 316. The supply flow passage 31 may pass through the valve 880 for opening and closing the supply flow passage 31 via a portion from which the vent flow passage 316 is branched. The valve 880 may be provided to prevent water from flowing backward when the pumping operation is not performed by the pump 5. That is, water may flow only in one direction of the supply flow passage 31 by the valve 880.

One side of the supply flow passage 31 may be connected to the distributor for supplying water to the humidifying pad 20. That is, the one side of the supply flow passage 31 may be connected to the water tank 3, the connection flow passage, the pump 5, the supply flow passage 31, the valve 880, and the distributor in the stated order, and the vent flow passage 316 may be provided to be branched from the supply flow passage 31. The vent flow passage 316 may be positioned at a location before the valve 880 in the supply flow passage 31. Water flowing in the supply flow passage 31 may flow to a side at which the valve 880 is positioned, via the portion from which the vent flow passage 316 is branched.

The vent valve 317 may be provided in the vent flow passage 316 and selectively opened. The vent flow passage 316 may be provided at a location higher than the highest water level of the water tank 3.

Figure 21:
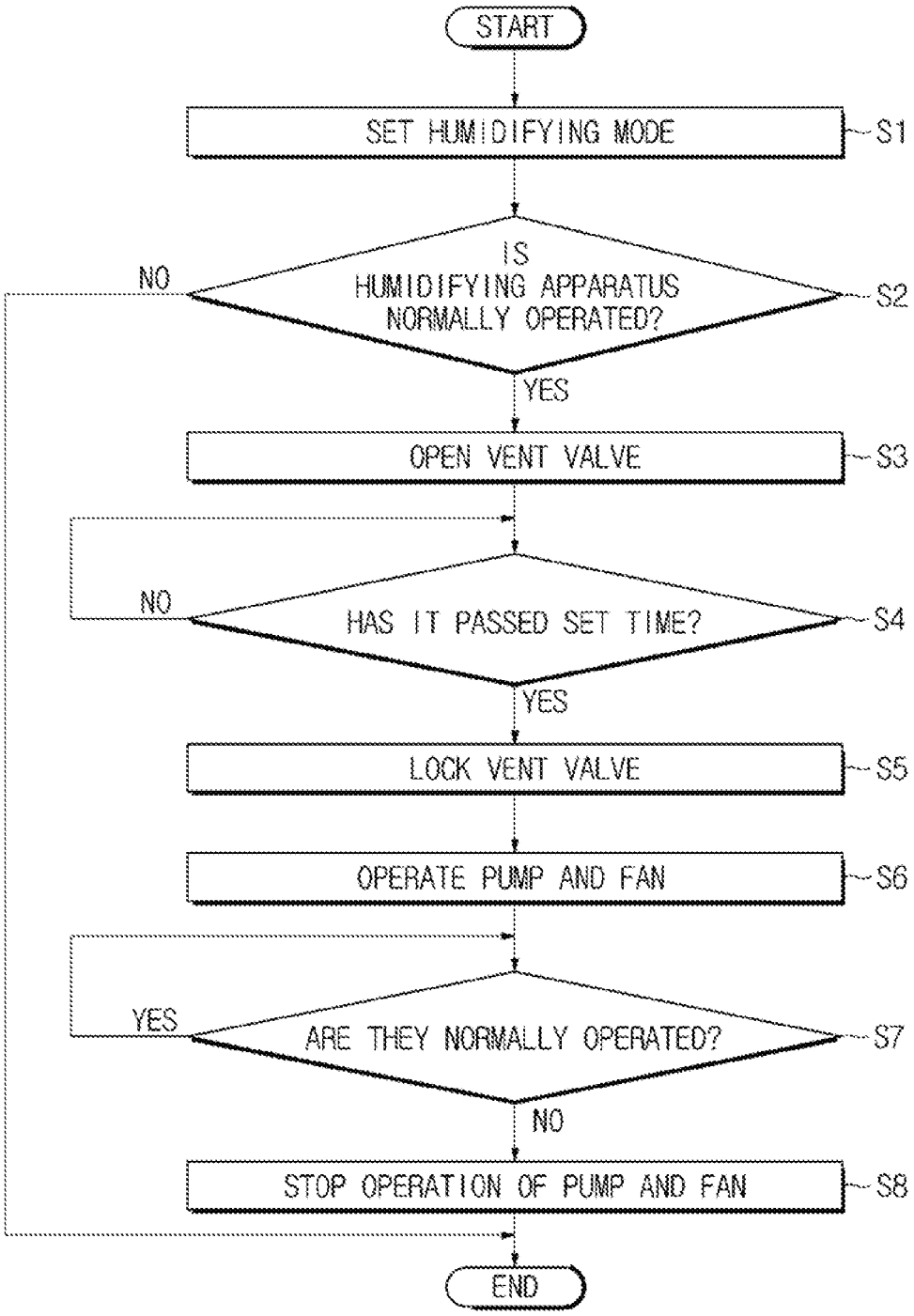
FIG. 21 illustrates a humidifying operation of a humidifying apparatus according to various embodiments of the present disclosure.

FIG. 21 is a flowchart showing a humidifying operation of a humidifying apparatus according to an embodiment of the present disclosure.

Referring to FIG. 21, when a humidifying mode of the humidifying apparatus 1 according to an embodiment of the present disclosure is set in an operation S1, a control unit provided in the humidifying apparatus 1 may first determine whether the humidifying apparatus 1 is normally operating in operation S2. Specifically, when the humidifying mode is automatically or manually selected, whether the pump 5, the fan assembly 6, and the like of the humidifying apparatus 1 are normally operating, whether the water tank 3, the humidifying pad 20, or the like is properly mounted, or the like may be determined.

For example, in a case of the pump 5, when an output amount larger than usual is detected, the humidifying apparatus 1 may be determined to be abnormally operated. When the filter or the like is clogged by foreign matter or when water in the water tank 3 is less than the reference amount, a load on the pump 5 may increase and the output amount of the pump 5 may increase. Accordingly, when the output amount of the pump 5 is detected as being high so that the humidifying mode is not operated, a user may take action such as replacing the filter, replenishing the water tank 3 with water, or the like, and then restart the humidifying mode.

When the humidifying apparatus 1 is determined to be abnormally operated due to a failure detected in the pump 5, the fan assembly 6, or the like, the humidifying mode may be terminated.

When the humidifying apparatus 1 is determined to be normally operated, the vent valve 317 may be opened in operation S3. The vent valve 317 may be opened for a preset time. For example, the vent valve 317 may be set in advance so as to be opened within a range of 1 to 10 seconds. By opening the vent valve 317 before the operation of the pump 5, the internal pressure and external pressure of the supply flow passage 31 may be made equal to each other and the pumping operation by the pump 5 may be smoothly performed.

When it is determined that the vent valve 317 is opened for the preset time in operation S4 and the preset time has elapsed, the vent valve 317 which is opened may be closed and locked in operation S5. The vent valve 317 is closed and locked to prevent water from being leaked via the vent flow passage 316, and then the pump 5 and the fan assembly 6 may be operated in operation S6.

During the operation of the pump 5 and the fan assembly 6, the control unit may determine whether the pump 5 and the fan assembly 6 are normally operated in operation S7. When it is determined that the pump 5 and the fan assembly 6 are normally operated, the operation of the humidifying mode may proceed continuously, but when it is determined that the pump 5 and the fan assembly 6 are abnormally operated due to the occurrence of a failure, the operation of the pump 5 and the fan assembly 6 may be stopped in operation S8, and the operation of the humidifying mode may be terminated.

In this manner, when it is determined that the pump 5 and the fan assembly 6 of the humidifying apparatus 1 are abnormally operating during the operation of the humidifying mode, the humidifying apparatus 1 may be prevented from continuously performing the abnormal operation without normally performing the humidifying operation, by stopping the operation of the humidifying mode.

Figure 22:
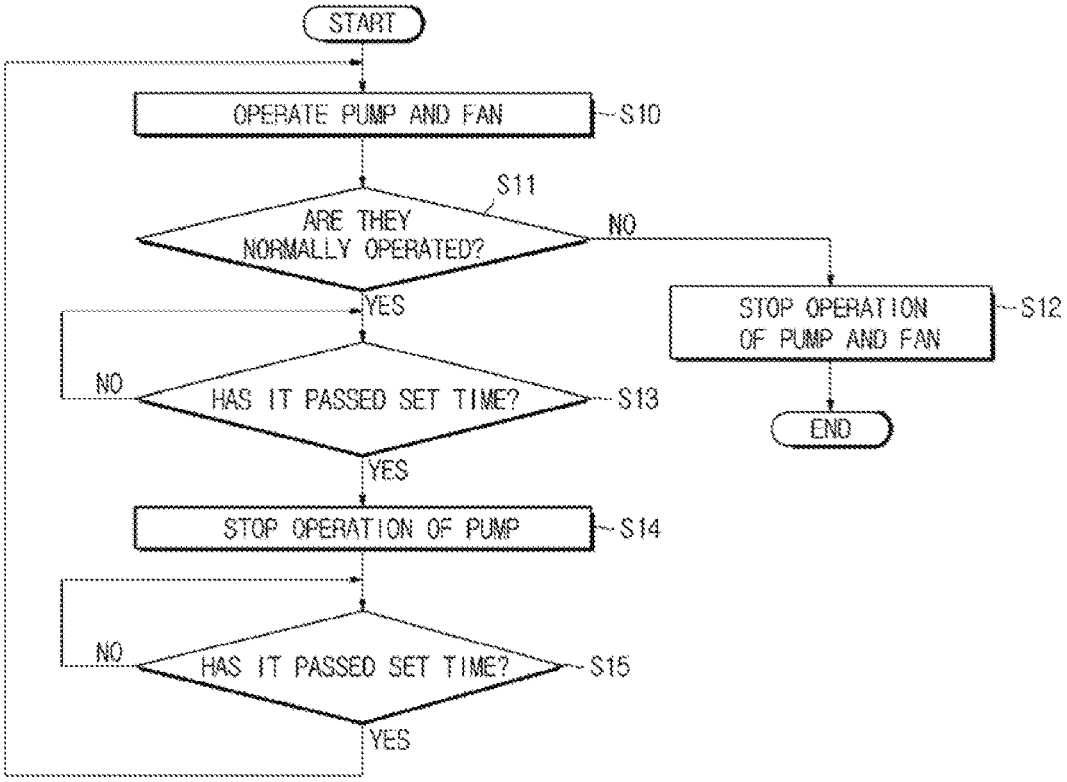
FIG. 22 illustrates an intermittent operation of a humidifying apparatus according to various embodiments of the present disclosure.

FIG. 22 is a flowchart showing an intermittent operation of a humidifying apparatus according to an embodiment of the present disclosure.

Referring to FIG. 22, the humidifying apparatus 1 according to an embodiment of the present disclosure may be provided to be intermittently operated. This is to maintain the humidifying efficiency while minimizing the usage of parts. For example, in the case of the pump 5, a cumulative operating time at the time of manufacturing the pump 5 may be approximately determined. Accordingly, the pump 5 may be intermittently operated, thereby extending the lifetime of the humidifying apparatus 1.

In order to intermittently operate the humidifying apparatus 1, the pump 5 and the fan assembly 6 may be operated in operation S10 and the control unit may determine whether the pump 5 and the fan assembly 6 are normally operated in operation S11. When it is determined that the pump 5 or the fan assembly 6 is abnormally operated, the operation of the pump 5 and the fan assembly 6 may be stopped in operation S12.

When it is determined that the pump 5 and the fan assembly 6 are normally operated, the pump 5 may be operated for a preset operating time. Here, the preset operating time of the pump 5 may be the same as or longer than a time during which the humidifying pad 20 is sufficiently moistened by water pumped by the pump 5.

When the humidifying pad 20 is 100% moistened, air blown by the fan assembly 6 cannot pass through the humidifying pad 20, and therefore a pumping time of the pump 5 may be preset so that the humidifying pad 20 may be appropriately moistened depending on the performance of the fan assembly 6 and the environment of the humidifying apparatus 1. As an example, the pumping time of the pump 5 may be preset so that the humidifying pad 20 may be moistened to approximately 30%.

When it is determined that the preset pumping time has elapsed in operation S13, the control unit may stop the operation of the pump 5 in operation S14. The pump 5 may be maintained in a stopped state caused by power-off for a preset time. The stop time of the pump 5 may be determined within a range of 30 seconds to 5 minutes. The humidifying pad 20 is in a moistened state even when the pump 5 is stopped, and therefore the fan assembly 6 may be operated to continue to perform the humidifying operation.

The control unit may determine whether the stop time of the pump 5 has elapsed in operation S15, and when it is determined that the preset stop time of the pump 5 has elapsed, the pump 5 may be restarted. The pump 5 and the fan assembly 6 may be both operated and the humidifying operation may be continuously performed.

When the pump 5 is restarted, the pump 5 may be controlled in such a manner that an output starts to be supplied to the pump 5 within a range of 50% to 70% of a rated output and gradually increases to reach 100% thereof. In this manner, the output supplied to the pump 5 gradually increases, thereby solving a problem of noise that may occur during the sudden restart of the pump 5.

Figure 23:
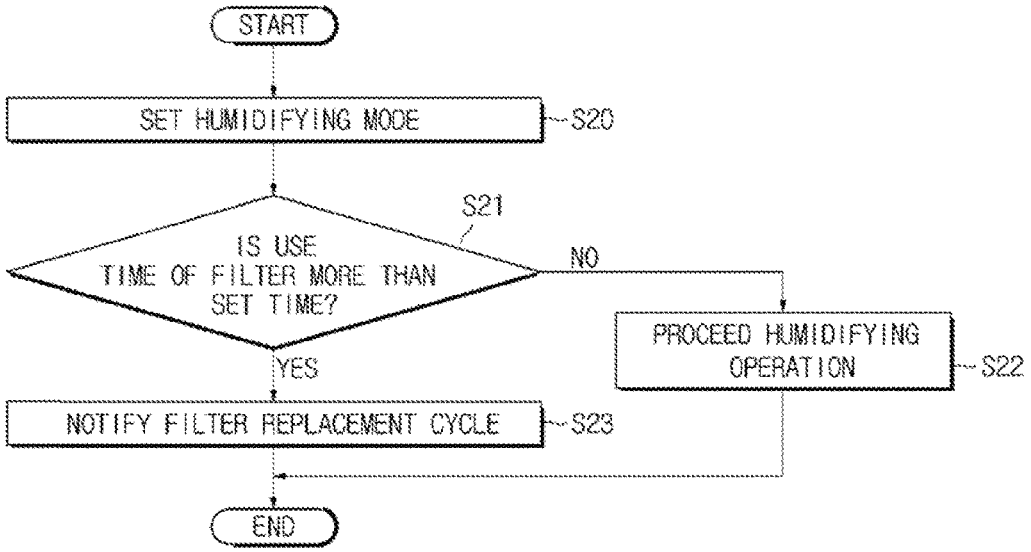
FIG. 23 illustrates a filter replacement notification of a humidifying apparatus according to various embodiments of the present disclosure.

FIG. 23 is a flowchart showing a filter replacement notification of a humidifying apparatus according to an embodiment of the present disclosure.

Referring to FIG. 23, the filter assembly 4 provided in the humidifying apparatus 1 according to an embodiment of the present disclosure may need to be replaced after it is used for a predetermined time in order to prevent a reduction in the filtering efficiency. The humidifying apparatus 1 may be provided with an alarm function which notifies a time for replacing the filter assembly 4.

When the humidifying mode is set in operation S20, the control unit may determine whether the usage time of the fan assembly 6 has passed a predetermined time in operation S21. When it is determined that the usage time of the filter assembly 6 has not passed the predetermined time, the humidifying operation may proceed in operation S22. When it is determined that the usage time of the filter assembly 6 has passed the predetermined time, it is possible to notify that the time for replacing the filter assembly 6 has arrived in operation S23.

In this case, the alarm for notifying that the time for replacing the filter assembly 6 has arrived may be actuated by a light provided in the humidifying apparatus 1, sound, or display of a display unit. A method of notifying that the time for replacing the filter assembly 6 has arrived is not limited to the above description.

Figure 24:
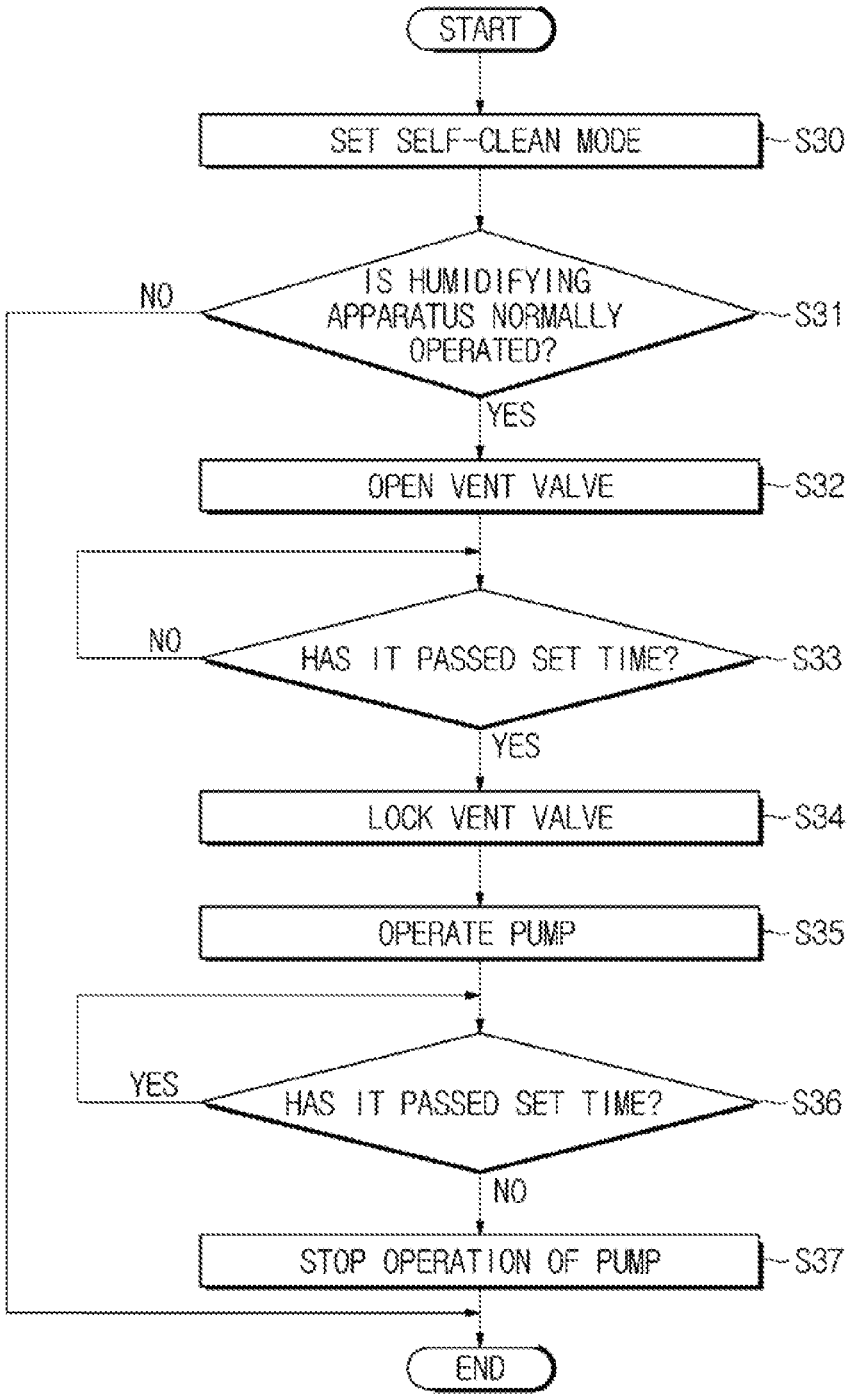
FIG. 24 illustrates a self-clean mode of a humidifying apparatus according to various embodiments of the present disclosure.

FIG. 24 is a flowchart showing a self-clean mode of a humidifying apparatus according to an embodiment of the present disclosure.

Referring to FIG. 24, the humidifying apparatus 1 according to an embodiment of the present disclosure may perform self-cleaning of the humidifying pad 20. The operating mode of the humidifying apparatus 1 may further include a self-clean mode in addition to the humidifying mode. When desiring to execute the self-clean mode, a user may replace water in the water tank 3 so that cleaning of the humidifying pad 20 may be performed by clean water. In the self-clean mode, the fan assembly 6 may not be operated and the humidifying pad 20 may be cleaned by water flowing in the humidifying pad 20.

When the self-clean mode of the humidifying apparatus 1 is set in operation S30, the control unit may determine whether the humidifying apparatus 1 is in a normal state in which the humidifying apparatus 1 is able to perform a self-clean operation S31. At this time, whether the pump 5 and the fan assembly 6 are normally operated, whether the humidifying pad 20, the water tank 3, and the like are properly mounted, and the like may be determined. When it is determined that the humidifying apparatus 1 is in an abnormal state, the self-clean mode may be terminated.

When it is determined that the humidifying apparatus 1 is in the normal state, the vent valve 317 may be opened in operation S32. When the vent valve 317 is opened, the internal pressure and external pressure of the supply flow passage 31 may be made equal to each other. The vent valve 317 may be kept opened for a preset time.

The control unit may determine whether the opening time of the vent valve 317 has passed the preset time in operation S33. When it is determined that the opening time of the vent valve 317 has passed the preset time, the vent valve 317 may be closed and locked in operation S34, and the pump 5 may be operated in operation S35. The pump 5 may pump water in the water tank 3 for a preset time. The pumped water may pass through the filter assembly 4 and be supplied to the humidifying pad 20. The water supplied to the humidifying pad 20 may clean the humidifying pad 20 while flowing in the humidifying pad 20.

The pump 5 may be operated for a preset time so that the humidifying pad 20 may be sufficiently cleaned. The control unit may determine whether the operating time of the pump 5 has passed a preset time in operation S36, and when it is determined that the operating time has passed the preset time, the operation of the pump 5 may be stopped in operation S37. Thus, the self-clean operation may be terminated.

When the self-clean operation is terminated, a user may clean the humidifying pad 20 and replace water recovered in the water tank 3 with new water.

In this manner, cleaning may be performed in a state in which the humidifying pad 20 is mounted in the humidifying apparatus 1 without being separated from the humidifying apparatus 1, so that user convenience may be improved.

Such a self-clean mode may be executed manually or automatically. The humidifying apparatus 1 may include an alarm function that calculates a cumulative operating time of the humidifying pad 20 and displays to execute the self-clean mode at every preset cycle. An alarm for notifying that the self-clean mode is needed may be actuated by a light, sound, or display of a display unit. A user may confirm the alarm, and then operate the self-clean mode. The self-clean mode may be automatically executed for every preset cycle.

Figure 25:
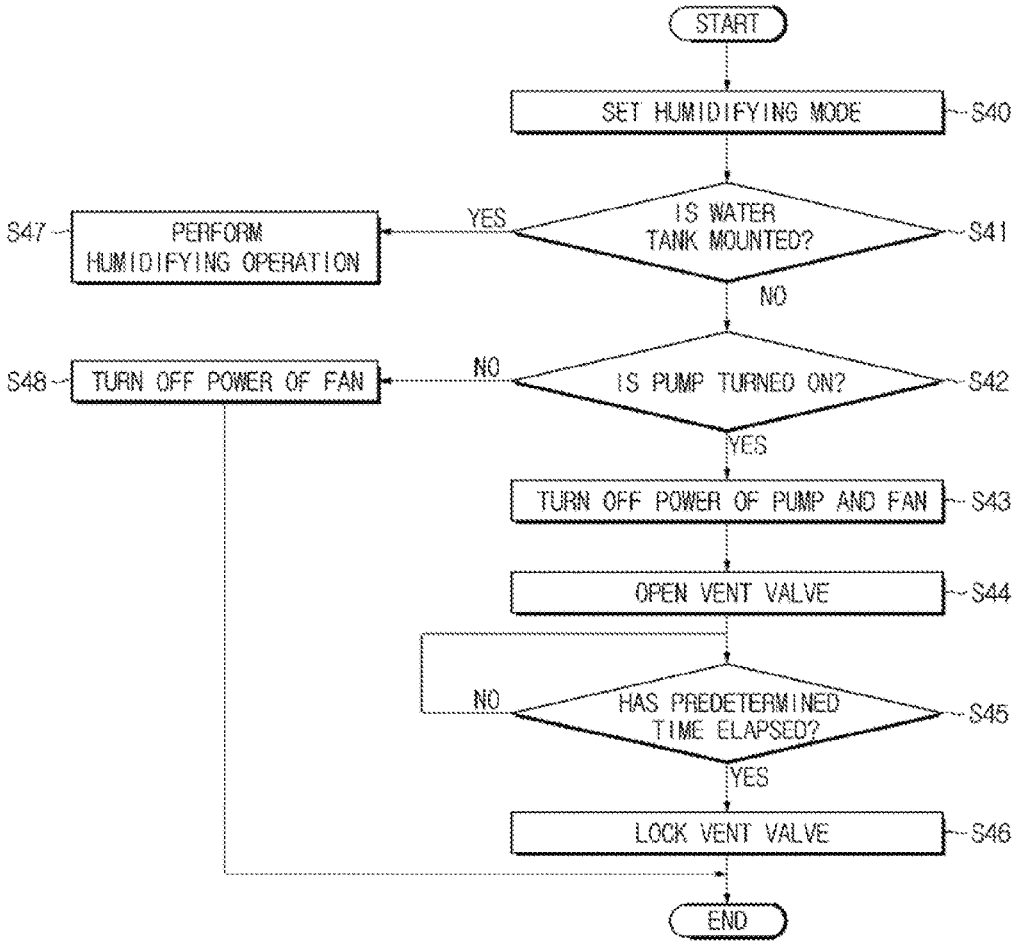
FIG. 25 illustrates a response mode that responds to separation of a water tank according to various embodiments of the present disclosure.

FIG. 25 is a flowchart showing a response mode that responds to separation of a water tank according to an embodiment of the present disclosure.

Referring to FIG. 25, when the pump 5 is operated in a state in which the water tank 3 of the humidifying apparatus 1 according to an embodiment of the present disclosure is not properly mounted, the vent valve 317 may be opened for a predetermined time.

For example, when the water tank 3 is forcibly separated during the use of the humidifying apparatus 1, the pump 5 or the fan assembly 6 may be continuously operated. In this case, the operation of either the pump 5 or the fan assembly 6 may be stopped, and the vent valve 317 may be opened for the predetermined time.

When the pump 5 is operated in a state in which the water tank 3 is separated, air may flow into the supply flow passage 31 by a pumping operation of the pump 5. Even though the water tank 3 is mounted later, water in the water tank 3 may not be pumped by the pump 5 due to the air flowing into the supply flow passage 31. Accordingly, when the pump 5 is operated in a state in which the water tank 3 is separated, the vent valve 317 may be opened for the predetermined time so that the air flowing into the supply flow passage 31 may be discharged.

Specifically, when the humidifying mode is set in operation S40, the control unit may determine whether the water tank 3 is mounted in operation S41. When it is determined that the water tank 3 is mounted, the humidifying operation S47 may be normally performed.

When it is determined that the water tank 3 is not mounted, the control unit may determine whether the pump 5 is turned on or off in operation S42. When the pump 5 is turned off, the control unit may terminate the humidifying operation by turning off the power of the fan assembly 6 in operation S48. At this time, when the power of the fan assembly 6 has been already turned off, an operation of turning off the power of the fan assembly 6 may be omitted and the humidifying operation may be immediately terminated.

When the water tank 3 is not mounted and the pump 5 is turned on, the power of each of the pump 5 and the fan assembly 6 may be turned off in operation S43.

After the pump 5 and the fan assembly 6 are turned off, the vent valve 317 may be opened in operation S44. The vent valve 317 may be opened for a predetermined time set in advance. The control unit may determine whether the opening time of the vent valve 317 has passed the predetermined time in operation S45, and when it is determined that the opening time of the vent valve 317 has passed the predetermined time, the vent valve 317 may be closed and locked in operation S46. By doing this, the operation related to a case in which the pump 5 is operated in the state in which the water tank 3 is not mounted may be terminated.

The water tank 3 may be forcibly separated even during the operation of the humidifying apparatus 1, and therefore the operation related to the case in which the pump 5 is operated in the state in which the water tank 3 is not mounted in operations S40 to S48 may be performed even during the operation of the humidifying apparatus 1 as well as before the humidifying apparatus 1 starts to perform the operation.

The humidifying apparatus 1 may be operated in conjunction with a smart device. A user may control the operation of the humidifying apparatus 1 using the smart device, and the state of the humidifying apparatus 1 may be displayed through the smart device.

As an example, when the replacement of the filter is required, when the replenishment of the water tank 3 with water is required, or when the humidifying pad and the water tank are required to be cleaned, the related information may be displayed on a user's smart device. In addition, a cumulative operating time of the humidifying apparatus 1, a daily operating time of the humidifying apparatus 1, a temperature or humidity of a space in which the humidifying apparatus 1 is installed, and the like may be displayed on the user's smart device.

The user may run or stop the operation of the humidifying apparatus 1 through a manipulation of the smart device from the outside of the space in which the humidifying apparatus 1 is installed. The user may run or stop the operation of the humidifying apparatus 1 using the information displayed on the smart device.

As described above, according to an embodiment of the present disclosure, water from which minerals, organic matter, and the like are removed may be supplied to the humidifying unit, so that the humidifying unit may be prevented from being contaminated.

In addition, the contamination of the humidifying unit may be prevented, and therefore a user may easily maintain and manage the humidifying apparatus.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A humidifying apparatus comprising:

a water tank configured to store water;

a filter assembly configured to filter the water stored in the water tank, wherein the water filtered by the filter assembly is supplied to a humidifying assembly, and circulating water remaining after being filtered flows into the water tank;

the humidifying assembly configured to perform humidification by absorbing and vaporizing the water filtered by the filter assembly;

a drain flow passage provided at a lower surface of the humidifying assembly, wherein residual water remaining after being absorbed in the humidifying assembly is recovered in the water tank via the drain flow passage; and a guide rib configured to guide the water recovered in the water tank is provided in the water tank, wherein the residual water recovered in the water tank by the drain flow passage is filtered by the filter assembly again with the circulating water in the water tank.

2. The humidifying apparatus according to claim 1, wherein, in the lower surface of the humidifying assembly, a height of one side of the humidifying assembly at which the drain flow passage is provided from a bottom surface on which the humidifying assembly is located is formed to be lower than a height of an other side thereof from the bottom surface.

3. The humidifying apparatus according to claim 1, wherein the drain flow passage is positioned to be biased toward one side of the humidifying assembly.

4. The humidifying apparatus according to claim 1, further comprising:

a pump connected to the drain flow passage, wherein the residual water remaining after being absorbed in the humidifying assembly is pumped by the pump and recovered in the water tank.

5. The humidifying apparatus according to claim 1, wherein a valve for opening and closing the drain flow passage is provided at the drain flow passage.

6. The humidifying apparatus according to claim 1, wherein a circulation flow passage through which the circulating water flows-in is further provided at the water tank.

7. The humidifying apparatus according to claim 6, wherein the circulation flow passage and the drain flow passage are provided as a single flow passage.

8. The humidifying apparatus according to claim 7, wherein, in the water tank, an inlet hole configured to communicate with a flow passage in which the circulation flow passage and the drain flow passage are provided as one is formed.

9. The humidifying apparatus according to claim 8, wherein the water tank is positioned below the humidifying assembly, and the inlet hole is provided in an upper surface of the water tank.

10. The humidifying apparatus according to claim 1, further comprising:

a pump configured to pump the water stored in the water tank and allow the pumped water to be delivered to the filter assembly.

11. The humidifying apparatus according to claim 10, wherein a supply flow passage through which water supplied to the pump passes is provided at the water tank.

12. The humidifying apparatus according to claim 11, wherein the supply flow passage extends toward a bottom surface of the water tank.

13. The humidifying apparatus according to claim 12, wherein a height of an end of the supply flow passage from the bottom surface of the water tank is in a range of 1/10 to 1/4 of a height from the bottom surface of the water tank to an upper surface thereof.

14. The humidifying apparatus according to claim 12, wherein the water tank comprises an inlet hole through which circulating water of the filter assembly and the residual water of the humidifying assembly flow-in, and the supply flow passage is configured to communicate with the inlet hole.

15. A humidifying apparatus comprising:

a water tank configured to store water;

a filter assembly configured to filter the water stored in the water tank;

a humidifying assembly configured to perform humidification by absorbing and vaporizing the water filtered by the filter assembly;

a drain flow passage provided at a lower surface of the humidifying assembly, wherein residual water remaining after being absorbed in the humidifying assembly is recovered in the water tank via the drain flow passage; and a pump configured to pump the water stored in the water tank and allow the pumped water to be delivered to the filter assembly, wherein a supply flow passage through which water supplied to the pump passes is provided at the water tank, wherein an inlet hole through which circulating water of the filter assembly and the residual water of the humidifying assembly flow-in is provided in the water tank, wherein the supply flow passage includes a first supply flow passage that extends inside of the water tank to the inlet hole and a second supply flow passage that is bent and extended from the first supply flow passage.

16. The humidifying apparatus according to claim 15, wherein the first supply flow passage extends parallel to a bottom surface of the water tank.

17. The humidifying apparatus according to claim 15, wherein the second supply flow passage is bent from the first supply flow passage and extends toward a bottom surface of the water tank.

18. The humidifying apparatus according to claim 15, wherein the supply flow passage includes a third supply flow passage that is bent from the second supply flow passage.

19. A humidifying apparatus comprising:

a humidifying pad configured to absorb and vaporize water;

a distributor in which a plurality of spray holes are provided to supply water to the humidifying pad;

a filter assembly connected to the distributor and configured to supply purified water to the distributor, wherein circulating water remaining in the filter assembly after being filtered flows into a water tank;

the water tank in which water supplied to the filter assembly is stored and a guide rib configured to guide flowing-in water is provided; and a humidifying pad frame into which the humidifying pad is mounted and a drain flow passage is provided at a lower surface thereof, wherein one side of the lower surface of the humidifying pad frame at which the drain flow passage is provided to have an inclined surface in such a manner that a height of the one side of the lower surface of the humidifying pad frame from a bottom surface is lower than a height of the other side thereof from the bottom surface, and residual water drained via a distribution flow passage is recovered in the water tank, and wherein the residual water recovered in the water tank by the drain flow passage is filtered by the filter assembly again with the circulating water in the water tank.

* * * * *